US011404823B2

(12) United States Patent
Holub et al.

(10) Patent No.: US 11,404,823 B2
(45) Date of Patent: Aug. 2, 2022

(54) BLIND MATE CONNECTOR SYSTEM AND METHOD FOR ASSEMBLING THEREOF

(71) Applicant: J.S.T. CORPORATION, Farmington Hills, MI (US)

(72) Inventors: Franklin A. Holub, West Bloomfield, MI (US); Darrell George, Novi, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 17/182,523

(22) Filed: Feb. 23, 2021

(65) Prior Publication Data

US 2021/0399469 A1 Dec. 23, 2021

Related U.S. Application Data

(60) Provisional application No. 63/042,317, filed on Jun. 22, 2020.

(51) Int. Cl.
*H01R 13/631* (2006.01)
*H01R 13/502* (2006.01)

(52) U.S. Cl.
CPC ..... *H01R 13/6315* (2013.01); *H01R 13/5025* (2013.01)

(58) Field of Classification Search
CPC ..... H01R 13/6456; H01R 13/5025; H01R 13/6315; H01R 13/4361
USPC ..... 439/246, 247, 248, 252, 677, 680, 352
See application file for complete search history.

(56) References Cited

U.S. PATENT DOCUMENTS 4,815,986 A * 3/1989 Dholoo ..... H01R 13/631 439/248
4,979,910 A * 12/1990 Revil ..... H01R 13/6272 439/357
5,080,604 A * 1/1992 Rider ..... H01R 13/631 439/357
5,288,242 A 2/1994 Muzslay
5,516,303 A * 5/1996 Yohn ..... H01R 13/6315 439/248
6,383,031 B1 * 5/2002 Law ..... H01R 13/187 439/680
7,214,080 B2 * 5/2007 Ichio ..... H01R 13/6272 439/246

(Continued)

OTHER PUBLICATIONS

International Search Report for International Application No. PCT/US2021/036854 dated Sep. 15, 2021 (2 sheets).

(Continued)

*Primary Examiner* — Marcus E Harcum
(74) *Attorney, Agent, or Firm* — Kratz, Quintos & Hanson, LLP

(57) ABSTRACT

A connector system that uses an elastomeric suspension to provide compliance for mating alignment and to provide an axial compression force of the two connector halves. This connector system uses a first connector half mounted to a body and a second connected half that comprises a rigidly mounted outer housing with elastomeric suspension element (s) that suspend an inner connector housing. The outer housing could be mounted to another body in such a way that the mating process of the two connector halves might not be observable. The axial compression force of the two connector halves keeps them tightly mated.

20 Claims, 39 Drawing Sheets

(56) References Cited

U.S. PATENT DOCUMENTS

| | | | | |
|---|---|---|---|---|
| 7,335,058 | B1 | 2/2008 | Burris | |
| 7,422,456 | B1 * | 9/2008 | Mitani | H01R 13/6315 439/247 |
| 7,588,449 | B2 * | 9/2009 | Takehara | H01R 13/5219 439/247 |
| 8,251,725 | B2 * | 8/2012 | Kasparian | H01R 13/187 439/252 |
| 8,408,927 | B2 * | 4/2013 | Tashiro | H01R 13/502 439/247 |
| 8,545,247 | B2 * | 10/2013 | Aldana | H01R 13/6315 439/248 |
| 9,431,756 | B2 * | 8/2016 | Kataoka | H01R 13/6315 |
| 2006/0094307 | A1 | 5/2006 | Woelfl | |
| 2008/0293277 | A1 * | 11/2008 | Kumar | H01R 13/53 439/247 |
| 2009/0149086 | A1 | 6/2009 | Dahms | |
| 2010/0124856 | A1 * | 5/2010 | Litteer | H01R 13/64 439/677 |
| 2015/0180150 | A1 * | 6/2015 | Shinder-Lerner | H01R 24/50 439/252 |
| 2016/0104969 | A1 * | 4/2016 | An | H01R 24/40 439/248 |
| 2016/0164233 | A1 * | 6/2016 | Zhu | H01R 24/50 439/248 |
| 2017/0271817 | A1 | 9/2017 | Pickel | |
| 2019/0020149 | A1 | 1/2019 | Wu | |
| 2020/0313354 | A1 * | 10/2020 | Bronk | H01R 13/111 |
| 2020/0313355 | A1 * | 10/2020 | Bronk | H01R 4/26 |
| 2020/0403343 | A1 * | 12/2020 | Bronk | H01R 13/2407 |
| 2021/0098916 | A1 * | 4/2021 | Lu | H01R 13/187 |
| 2022/0006239 | A1 * | 1/2022 | Shioda | H01R 12/91 |

OTHER PUBLICATIONS

International Preliminary Report on Patentability for International Application No. PCT/US2021/036854 dated Jan. 13, 2022 (5 sheets).

* cited by examiner

BLIND MATE CONNECTOR SYSTEM AND METHOD FOR ASSEMBLING THEREOF

CROSS-REFERENCE TO RELATED APPLICATIONS

This patent application claims priority to U.S. Provisional Patent Application Ser. No. 63/042,317 filed Jun. 22, 2020, which is hereby incorporated herein by reference in its entirety.

BACKGROUND OF THE INVENTION

The present invention generally relates to a connector system that uses an elastomeric suspension to provide compliance for mating alignment and also to provide an axial compression force of two connector halves.

SUMMARY OF THE INVENTION

The present invention generally relates to a connector system comprised of a first connector half that includes a female connector and a second connector half that includes a male connector. The male connector includes a male outer housing, a suspension, and a male inner housing.

When the connector system is in its assembled state, the suspension is in the male outer housing. The male inner housing is suspended by the suspension. The male outer housing can be mounted to a first body, and the female connector can be fastened to a second body.

The male outer housing may be mounted to the first body in such a way that the mating process of the two connector halves might not be observable, hence the name blind mate connector. The axial compression force of the two connector halves keeps them tightly mated to eliminate relative movement between them.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanations without limiting the scope of the invention as claimed.

DETAILED DESCRIPTION OF THE PREFERRED EMBODIMENTS

Figure 1A:
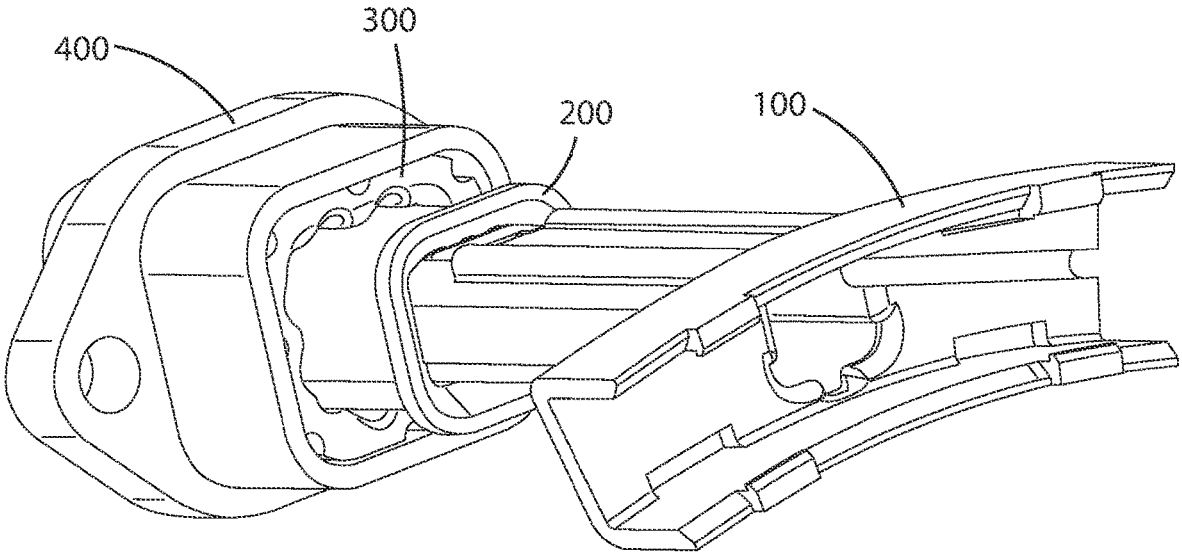
FIG. 1A is a perspective view of an assembled connector system, in accordance with the principles of a first embodiment of the present invention, showing a female connector and male connector.
Figure 11:
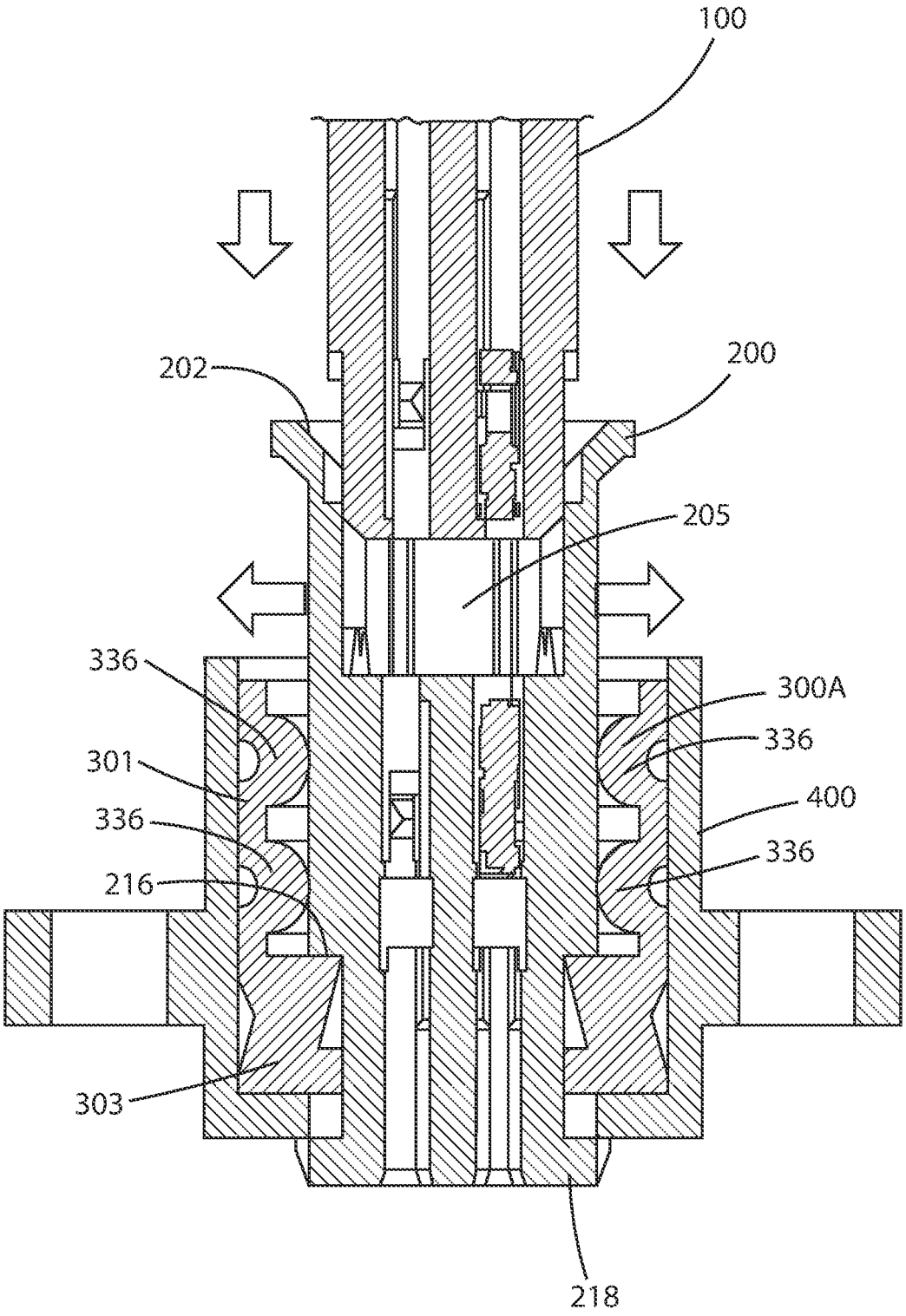
FIG. 11 is a cross-sectional view of a portion of a connector system, in accordance with the principles of a second embodiment of the present invention, showing a female connector and male connector.
Figure 12:
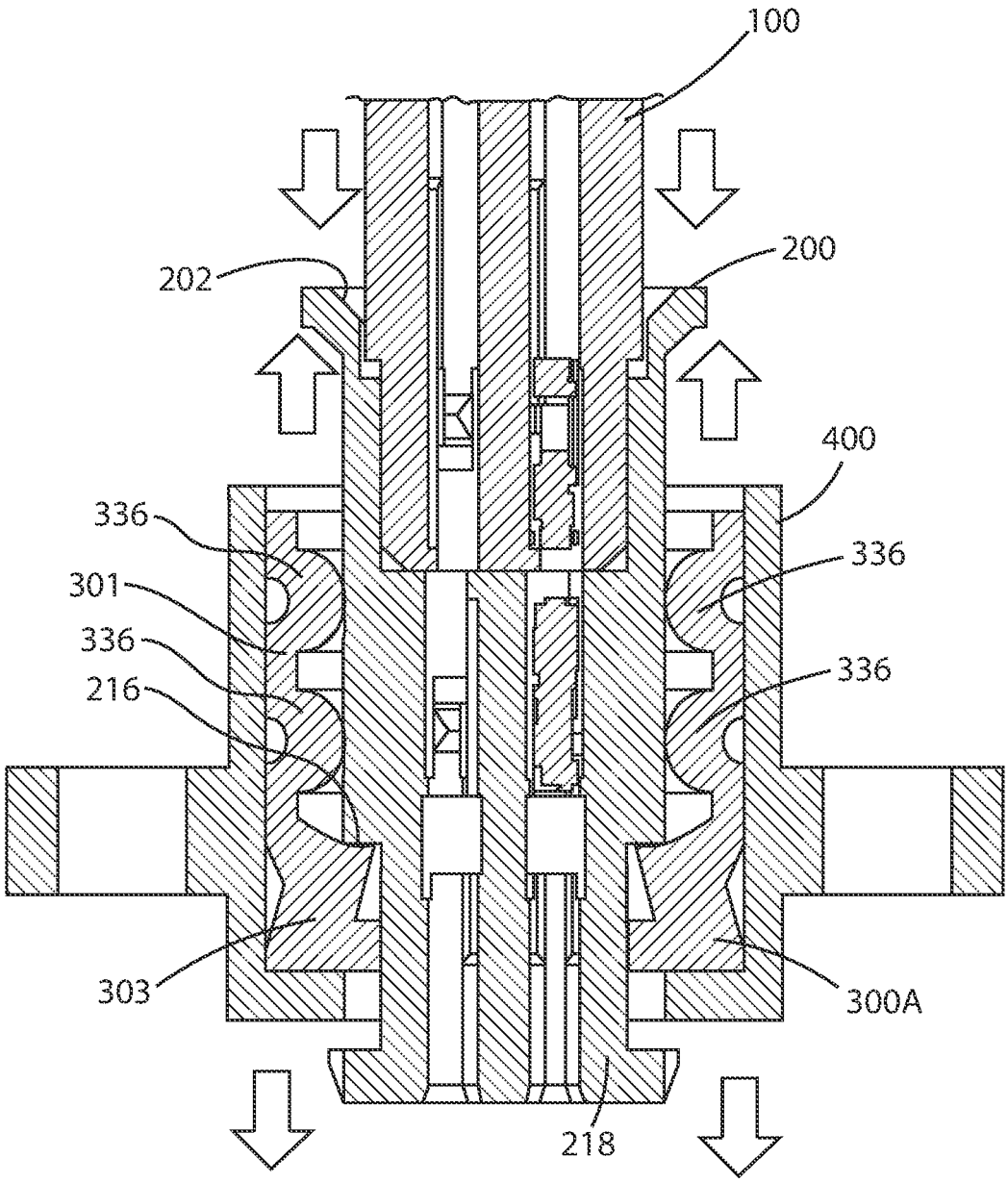
FIG. 12 is a cross-sectional view of a portion of a connector system, in accordance with the principles of the second embodiment of the present invention, showing a female connector and male connector.

FIG. 1A is a perspective view of an assembled connector system, in accordance with the principles of a first embodiment of the present invention, showing a female connector and male connector. FIG. 1A shows a female connector 100 and a male connector which includes a male inner housing 200, a suspension 300, and a male outer housing 400. The suspension 300 shown in FIG. 1A is the first embodiment. The suspension 300A shown in FIG. 11 and FIG. 12 is the second embodiment.

Figure 1B:
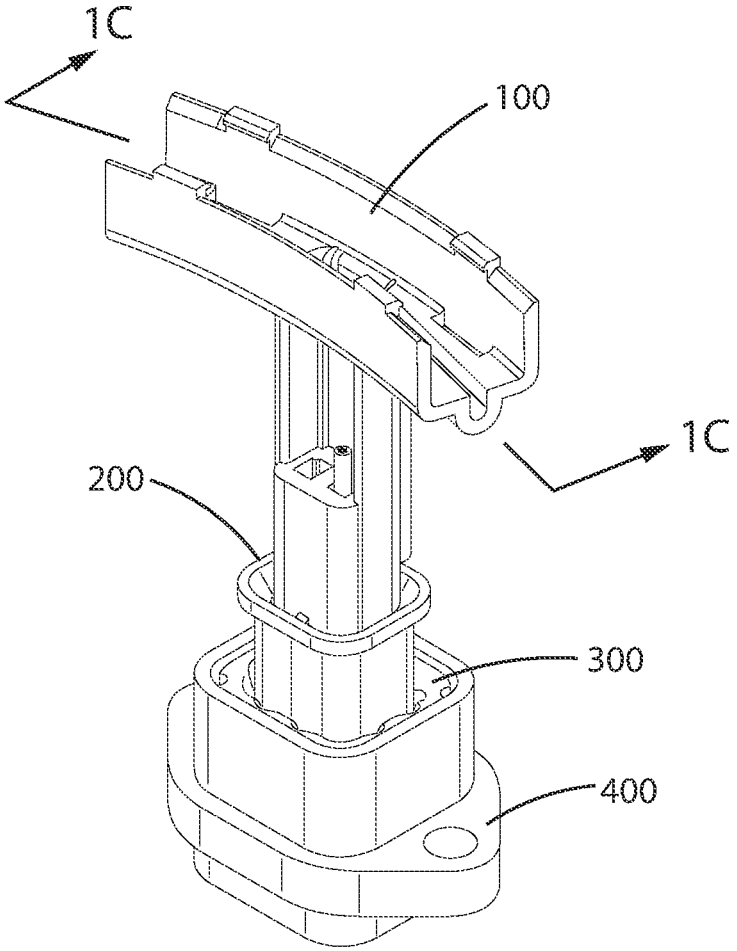
FIG. 1B is a perspective view of the assembled connector system of FIG. 1A.
Figure 1C:
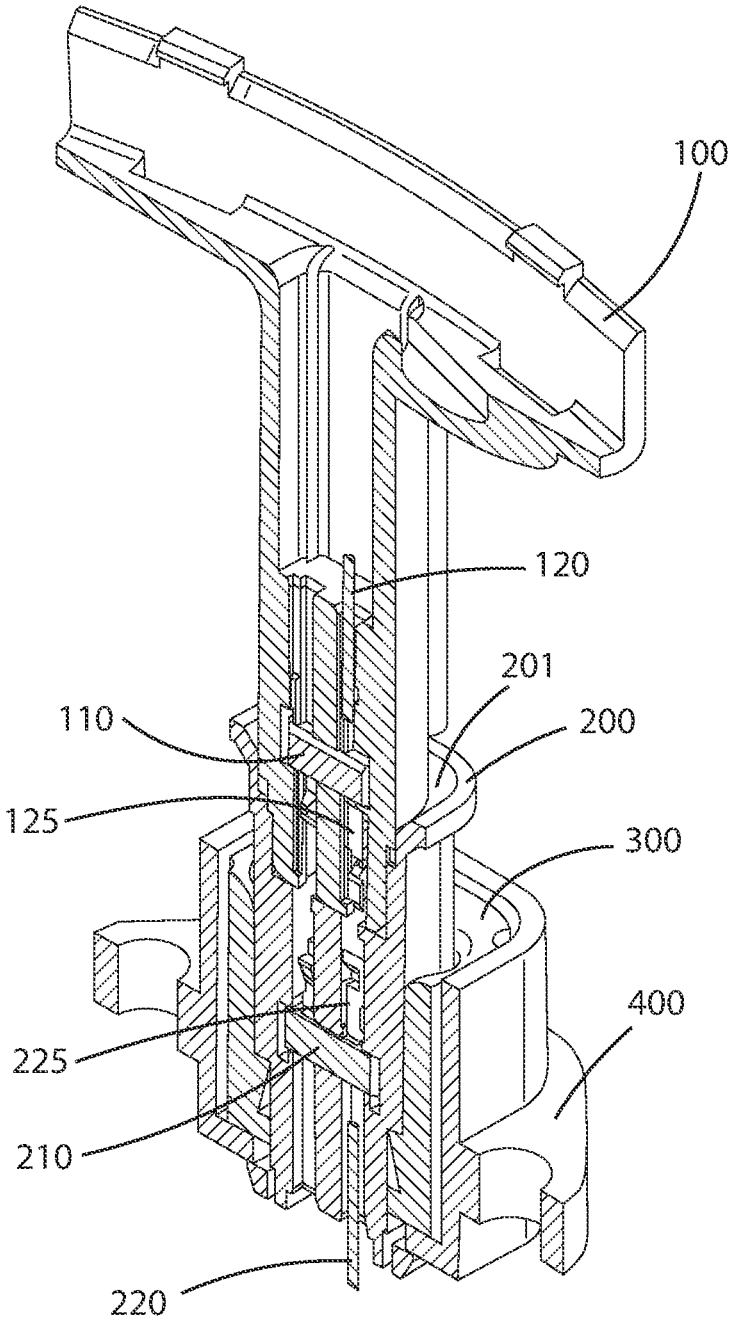
FIG. 1C is a cross-sectional view, taken along line 1C-1C in FIG. 1B.

FIG. 1B is a perspective view of the assembled connector system of FIG. 1A. FIG. 1C is a cross-sectional view, taken along line 1C-1C in FIG. 1B. FIG. 1C shows the female connector 100, the male inner housing 200, the suspension 300, and the male outer housing 400, and also shows a female terminal position assurance (TPA) member 110 inserted into the female connector 100, a wire 120 in the female connector 100, a female terminal box 125, a male terminal position assurance (TPA) member 210 inserted into the male inner housing 200, a wire 220 in the male inner housing 200, and a male terminal box 225.

Figure 1D:
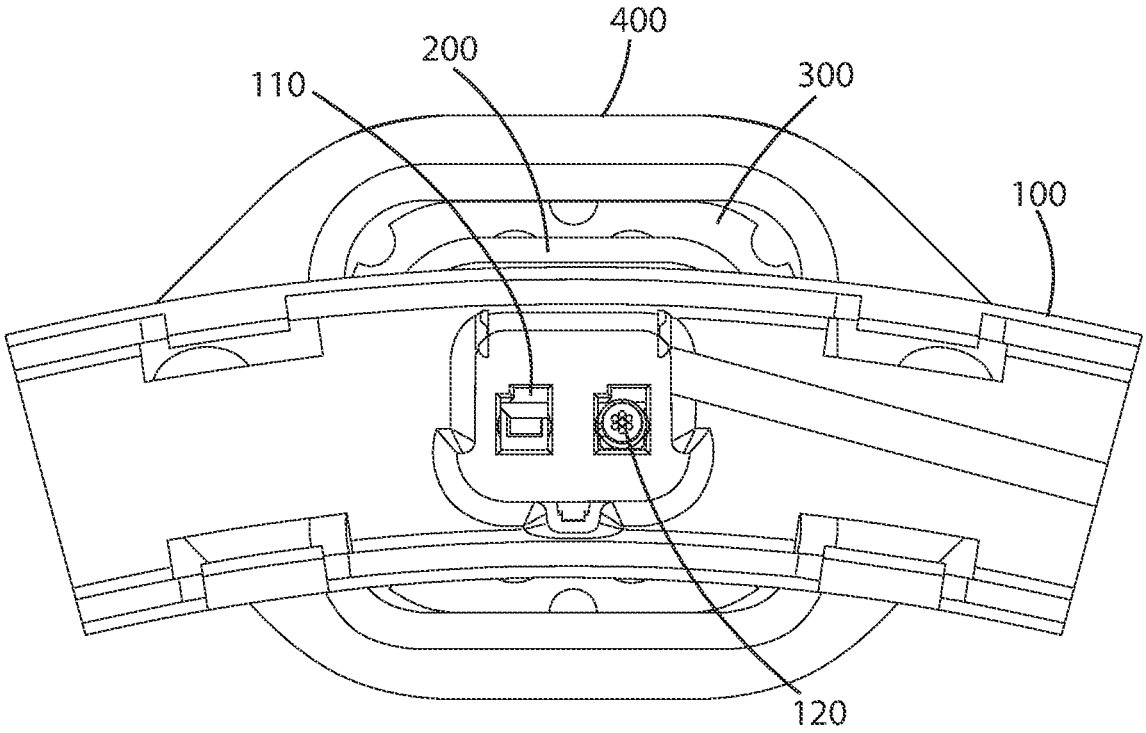
FIG. 1D is a top end elevational view of the assembled connector system of FIG. 1A.
Figure 1E:
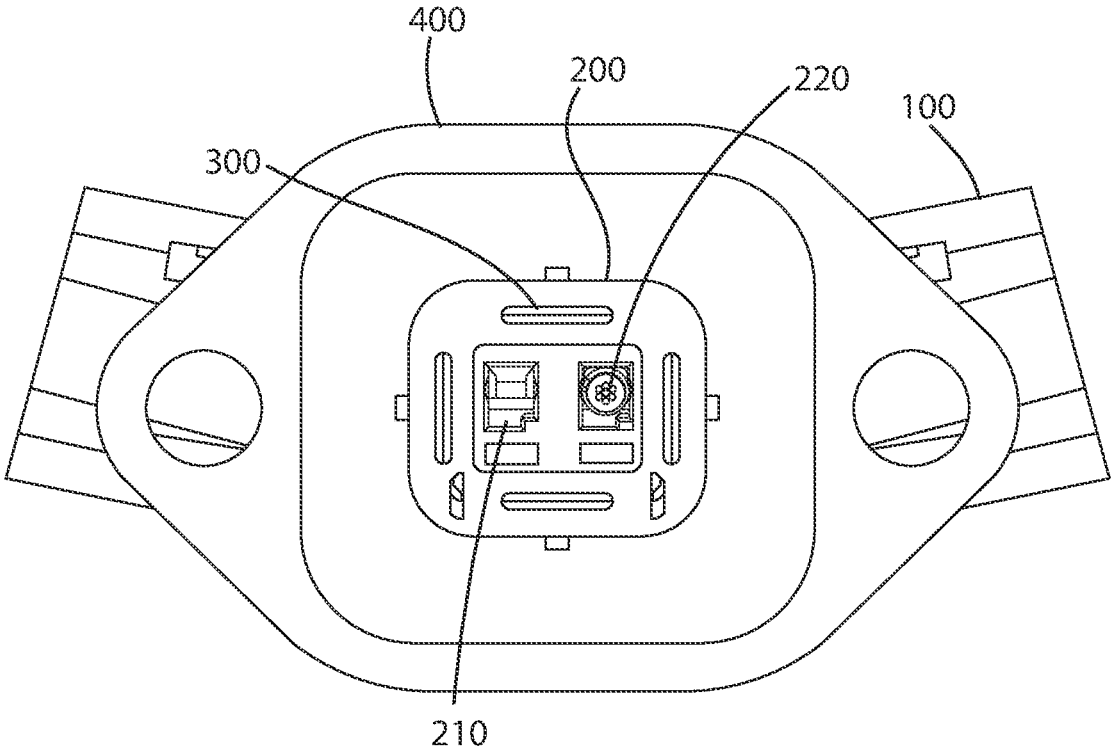
FIG. 1E is a bottom end elevational view of the assembled connector system of FIG. 1A.
Figure 1F:
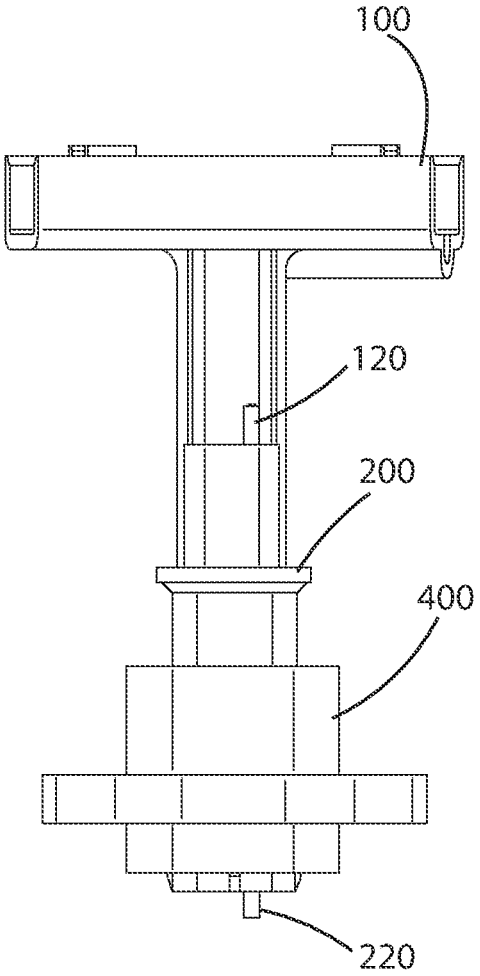
FIG. 1F is a front elevational view of the assembled connector system of FIG. 1A.
Figure 1G:
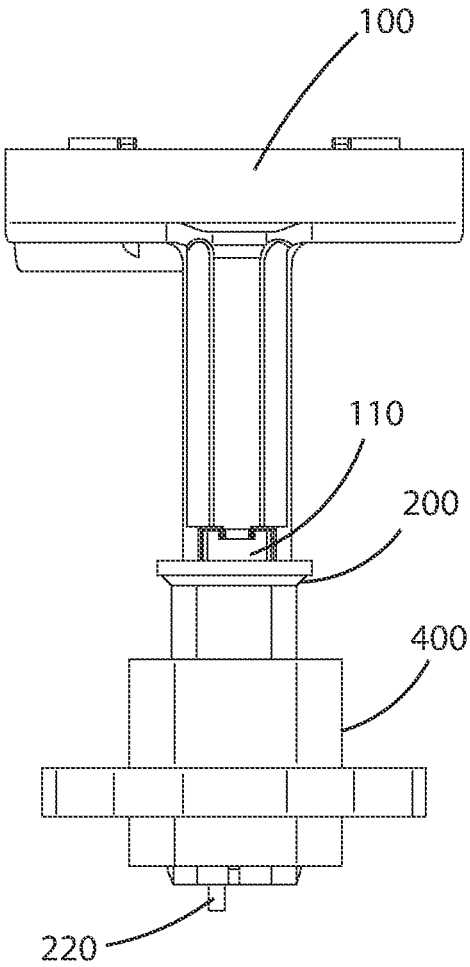
FIG. 1G is a back elevational view of the assembled connector system of FIG. 1A.
Figure 1H:
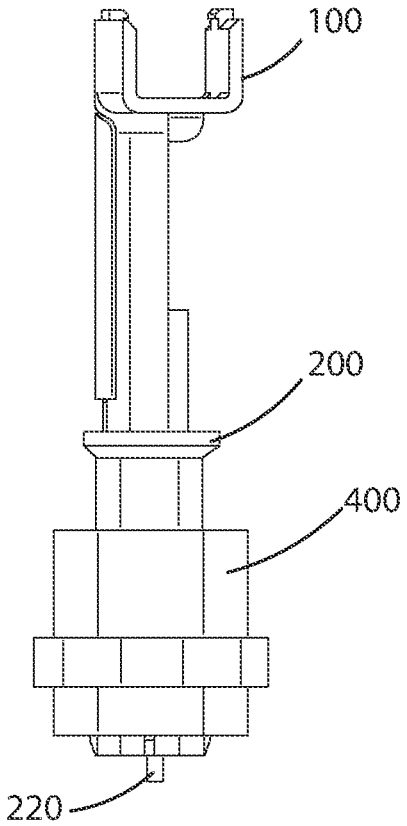
FIG. 1H is a right side elevational view of the assembled connector system of FIG. 1A.
Figure 1I:
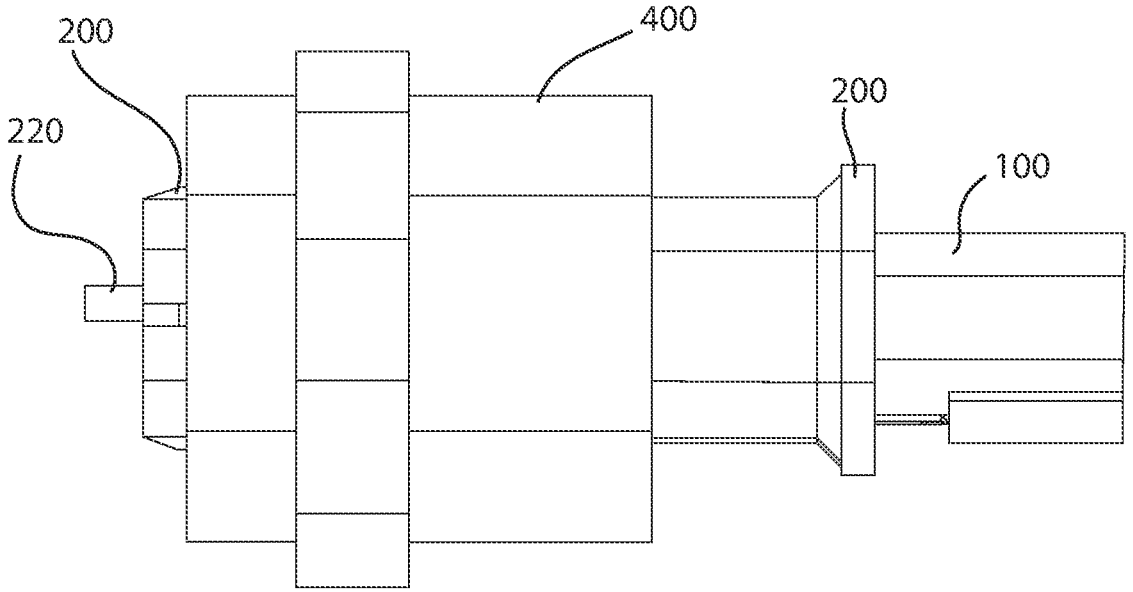
FIG. 1I is a left side elevational view of a portion of the assembled connector system of FIG. 1A.

FIG. 1D is a top end elevational view of the assembled connector system of FIG. 1A. FIG. 1E is a bottom end elevational view of the assembled connector system of FIG. 1A. FIG. 1F is a front elevational view of the assembled connector system of FIG. 1A. FIG. 1G is a back elevational view of the assembled connector system of FIG. A. FIG. 1H is a right side elevational view of the assembled connector system of FIG. 1A. FIG. 1I is a left side elevational view of a portion of the assembled connector system of FIG. 1A.

Figure 1J:
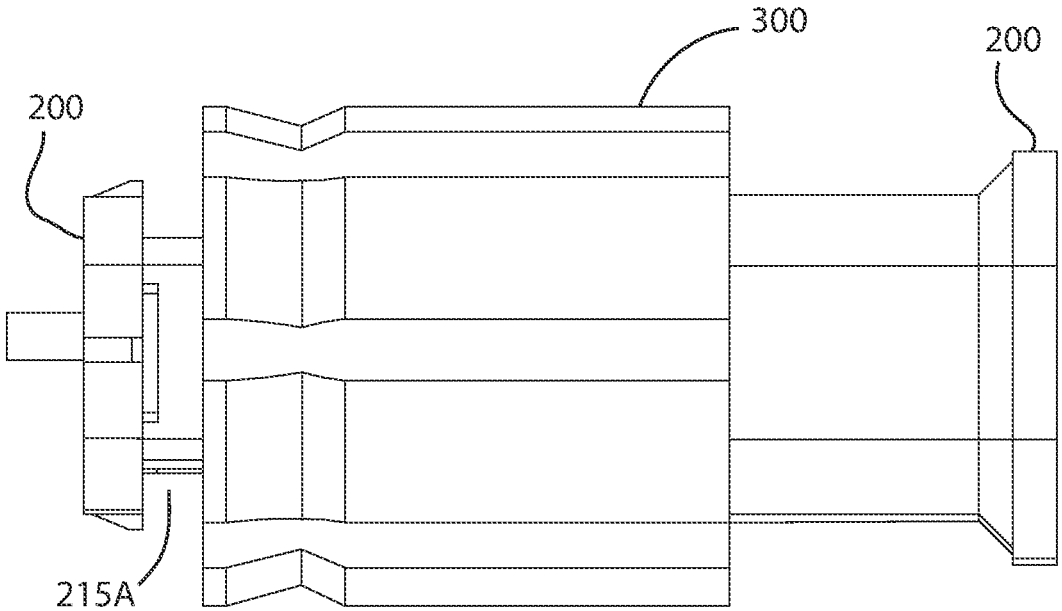
FIG. 1J is a left side elevational view of a suspension, a male inner housing, and components of the male inner housing, in accordance with the principles of the first embodiment of the present invention.

FIG. 1J is a left side elevational view of the suspension 300, a male inner housing 200, and components of the male inner housing 200, in accordance with the principles of the first embodiment of the suspension 300 of the present invention. FIG. 1J shows the male inner housing 200 assembled with the suspension 300, at a time prior to being assembled with the male outer housing 400 and the female connector 100. A notch region 215A of the male inner housing 200 is depicted at an area beyond the suspension 300. The notch region 215A accommodates a ledge 440 of the male outer housing 400, when the male outer housing 400 is assembled with the male inner housing 200 and the suspension 300. The notch region 215A is near the bottom of the male inner housing 200. The ledge 440 is shown in FIG. 5B, for example.

Figure 2A:
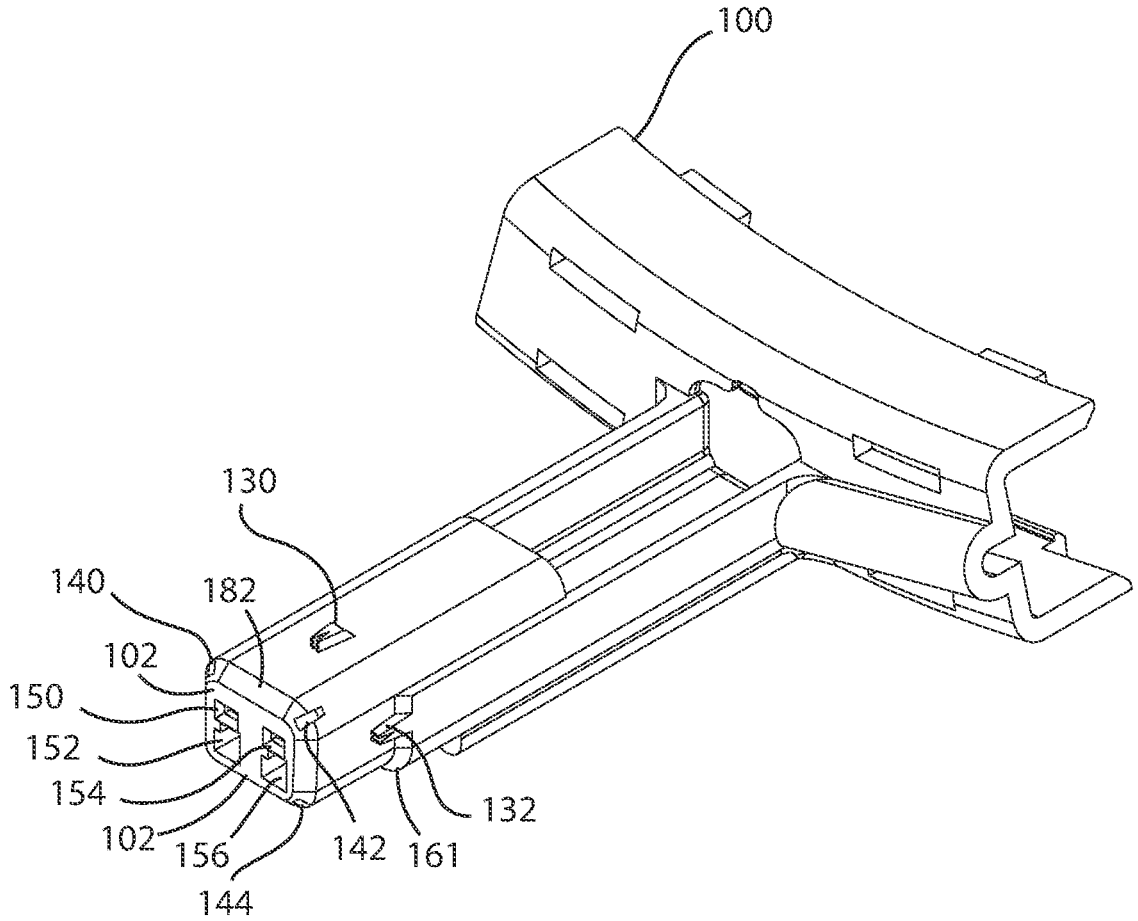
FIG. 2A is a perspective view of a female connector, showing the front and bottom end of the female connector, in accordance with the principles of the present invention.

FIG. 2A is a perspective view of a female connector, showing the front and bottom end of the female connector, in accordance with the principles of the present invention. FIG. 2A and shows that the female connector 100 has apertures 140, 142, 144, on the bottom end at respective corners thereof. The apertures 140, 142, 144 can be referred to as fork-receiving apertures. The bottom end of the female connector 100 can be referred to as the first end of the female connector 100, or can be referred to as the bottom of the female connector 100. The bottom of the female connector 100, is also considered the mating end, and has a bottom beveled edge 182 around its perimeter. The bottom beveled edge 182 narrowly tapers from each respective sides of the female connector 100 and narrowing towards and ending at a bottom surface 102 of the female connector 100. The bottom beveled edge 182 aids in insertion and mating of the female connector 100 with the male inner housing 200, and the bottom beveled edge 182 may interact with the tapered lead-in 202 of the male inner housing 200 (see, FIG. 11). As in FIG. 2E, more specifically, each of the apertures 140, 142, 144, 146 are also formed into a corner portion of the bottom beveled edge 182.

Figure 2B:
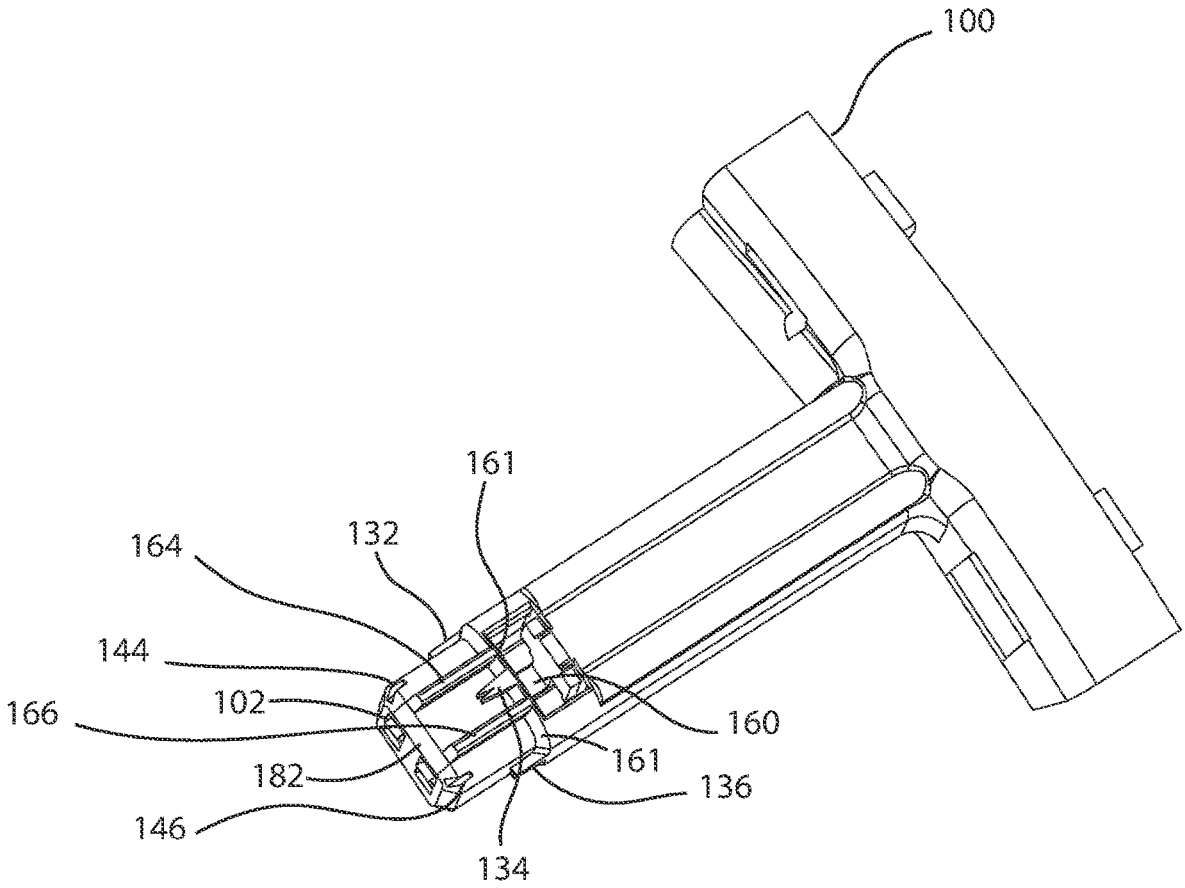
FIG. 2B is a perspective view of the female connector of FIG. 2A, showing the back and bottom end of the female connector.
Figure 2C:
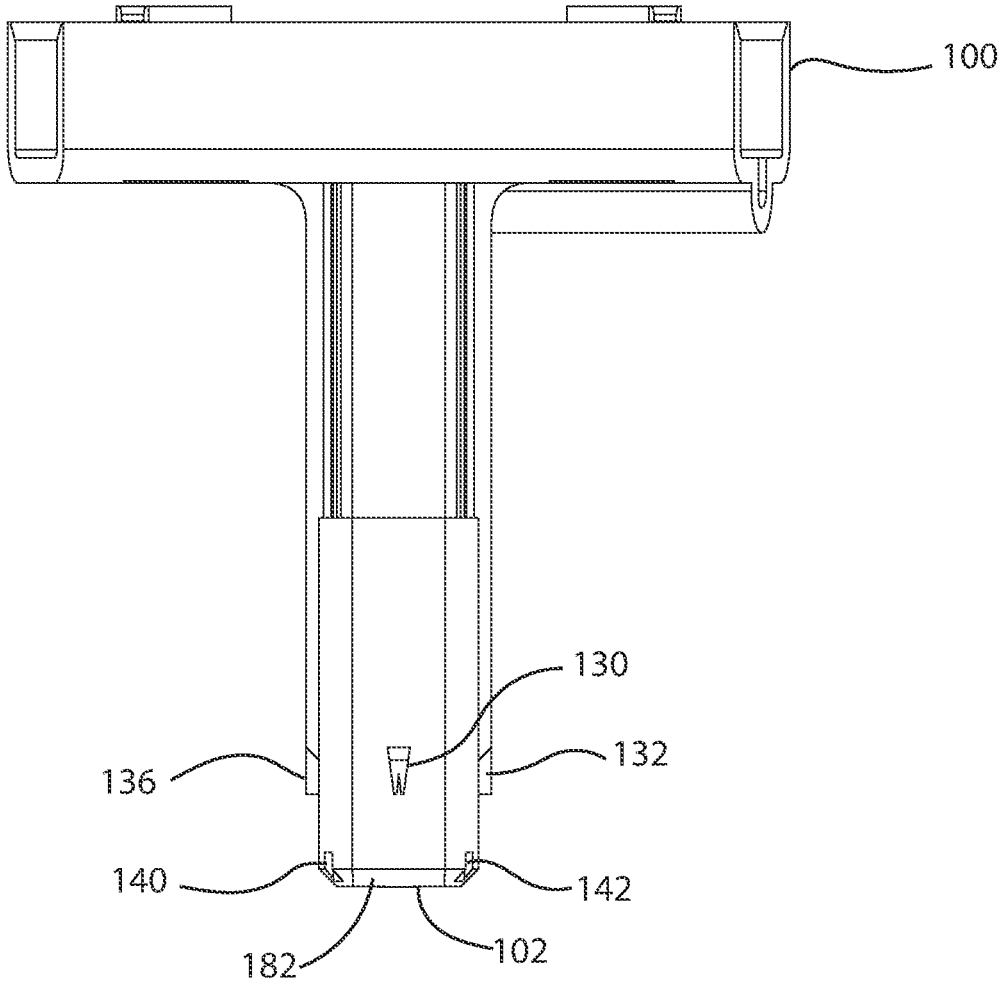
FIG. 2C is a front elevational view of the female connector of FIG. 2A.
Figure 2D:
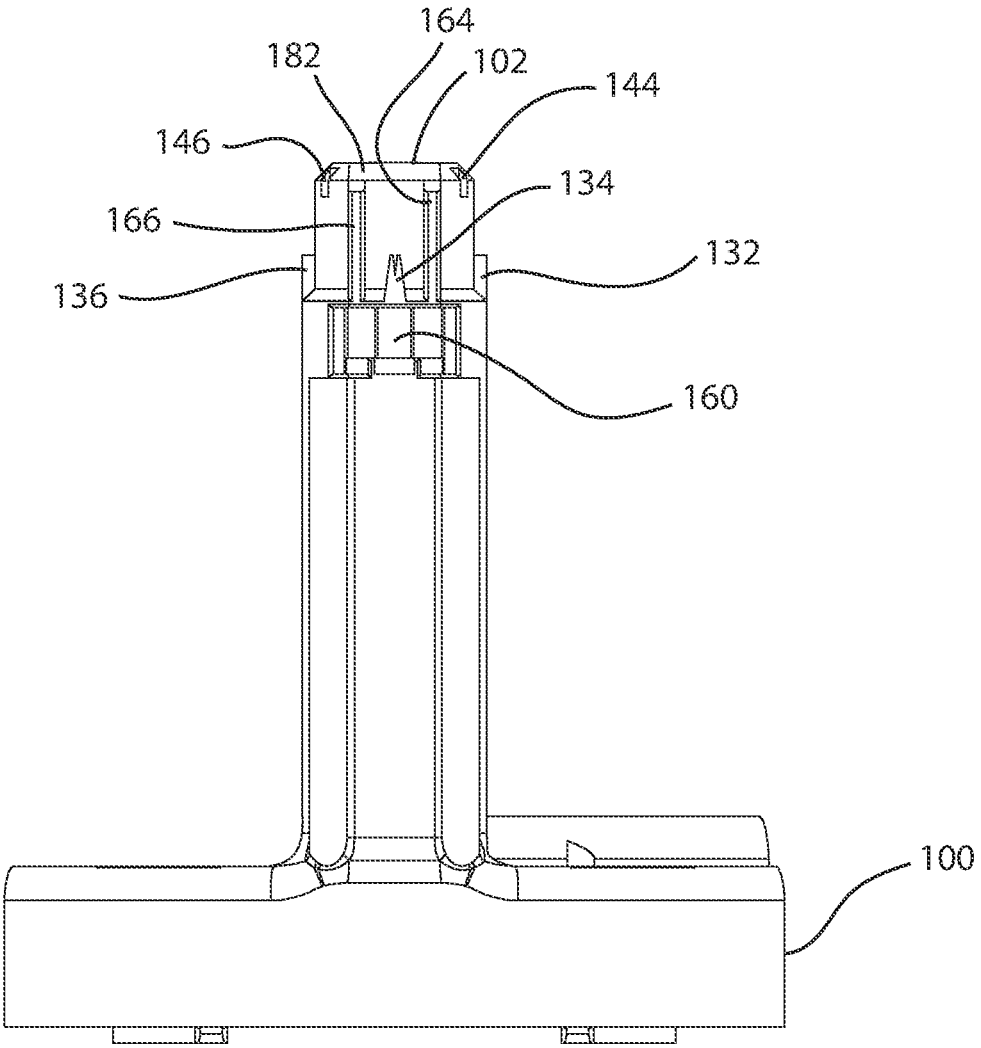
FIG. 2D is a back elevational view of the female connector of FIG. 2A.
Figure 2E:
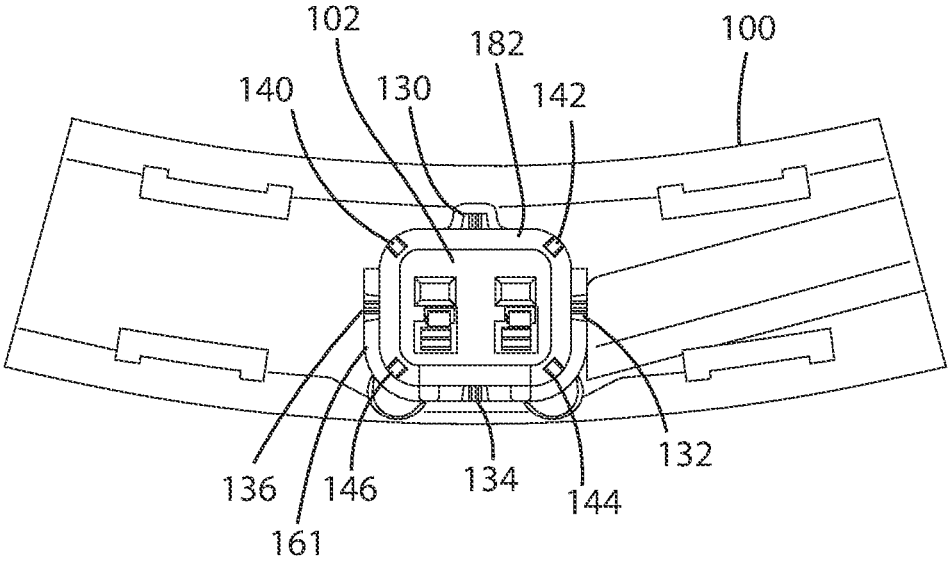
FIG. 2E is a bottom end elevational view of the female connector of FIG. 2A.

FIG. 2E, also shows fork-receiving aperture 146. The fork-receiving apertures 140, 142, 144, 146 will receive a fork-shaped protrusion 240, 242, 244, 246 of the male inner housing 200 (shown in FIG. 3E, for example) when the female connector 100 is fully assembled and mated with the male inner housing 200.

As depicted in FIG. 2A, the female connector 100 bottom surface 102 also includes apertures 150, 152, 154, and 156.

FIG. 2A depicts that the front of the female connector 100 has a fork-shaped protrusion 130. The fork-shaped protrusion 130 will be received into a fork-receiving aperture 230 of the male inner housing 200 (shown in FIG. 3E, for example) when the female connector 100 is assembled with the male inner housing 200.

FIG. 2A depicts that the left side of the female connector 100 has a fork-shaped protrusion 132. The fork-shaped protrusion 132 will be received into a fork-receiving aperture 232 of the male inner housing 200 (shown in FIG. 3E, for example) when the female connector 100 is assembled with the male inner housing 200.

FIG. 2B is a perspective view of the female connector of FIG. 2A, showing the back and bottom end of the female connector. The back of the female connector 100 has an aperture 160 for receiving the female TPA member 110, the aperture extending into the female connector 100 and centrally located on one of its sides. The female connector 100 also has a beveled edge 161 which narrowly tapers from a portion of three of the four respective sides of the female connector 100 and narrowing towards the bottom surface 102 of the female connector 100. The beveled edge 161 is located further towards the bottom surface 102 than the aperture 160. Further, as seen in FIG. 8B, the beveled edge 161 has an angle of taper which allows it to fit substantially flush and be received by a portion of the tapered lead-in 202 of the male inner housing when the female connector 100 is assembled with the male inner housing 200.

FIG. 2B depicts that the back of the female connector 100 has a fork-shaped protrusion 134. The fork-shaped protrusion 134 will be received into a fork-receiving aperture 234 of the male inner housing 200 (shown in FIG. 3E, for example) when the female connector 100 is assembled with the male inner housing 200. The fork-shaped protrusion 134 is formed to extend from a portion of the beveled edge 161 of the respective the side of the female connector 100 having the aperture 160, and extend in a direction toward the bottom surface 102 of the female connector 100, as depicted in FIG. 2B.

FIG. 2B depicts that the right side of the female connector 100 has fork-shaped protrusions 132 and 136. The fork-shaped protrusions 132 and 136 are formed to extend from two opposite portions of the beveled edge 161 of two opposing sides of the female connector 100, and the portion of the of the beveled edge 161 having of the fork-shaped protrusion 134 being between. The protrusions 132 and 136 extend in a direction toward the bottom surface 102 of the female connector 100. The fork-shaped protrusion 136 will be received into a fork-receiving aperture 236 of the male inner housing 200 (shown in FIG. 3E, for example) when the female connector 100 is assembled with the male inner housing 200.

FIG. 2B shows fork-receiving aperture 144 and fork-receiving aperture 146 on corners of the bottom of the female connector 100. An alignment protrusion 164 and an alignment protrusion 166 are shown on the back of the female connector 100 and extend from the beveled edge 161 towards the bottom surface 102 of the female connector 100.

Figure 2F:
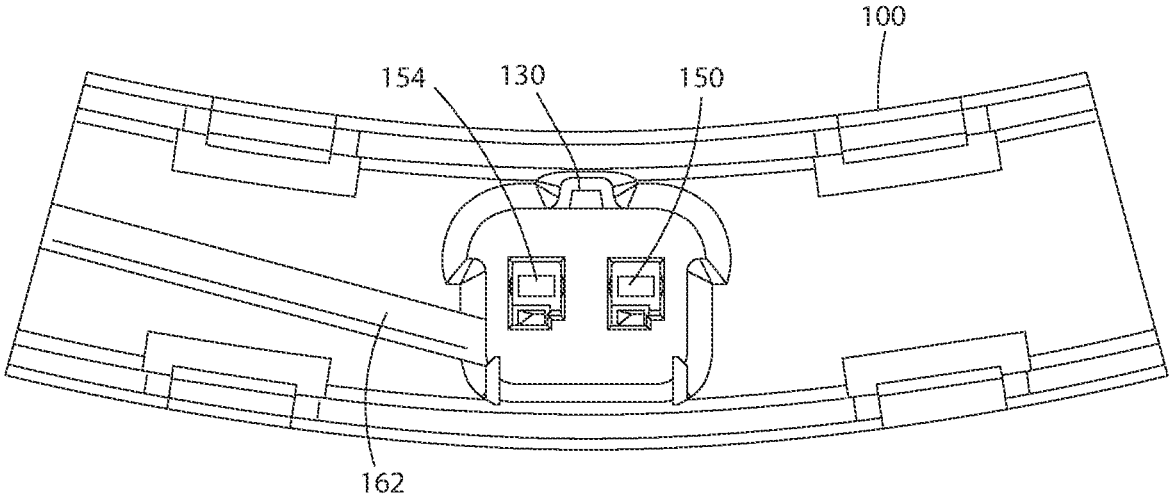
FIG. 2F is a top end elevational view of the female connector of FIG. 2A.

FIG. 2C is a front elevational view of the female connector of FIG. 2A. FIG. 2D is a back elevational view of the female connector of FIG. 2A. FIG. 2E is a bottom end elevational view of the female connector of FIG. 2A. FIG. 2F is a top end elevational view of the female connector of FIG. 2A. FIG. 2F shows a wire routing channel 162.

Figure 2G:
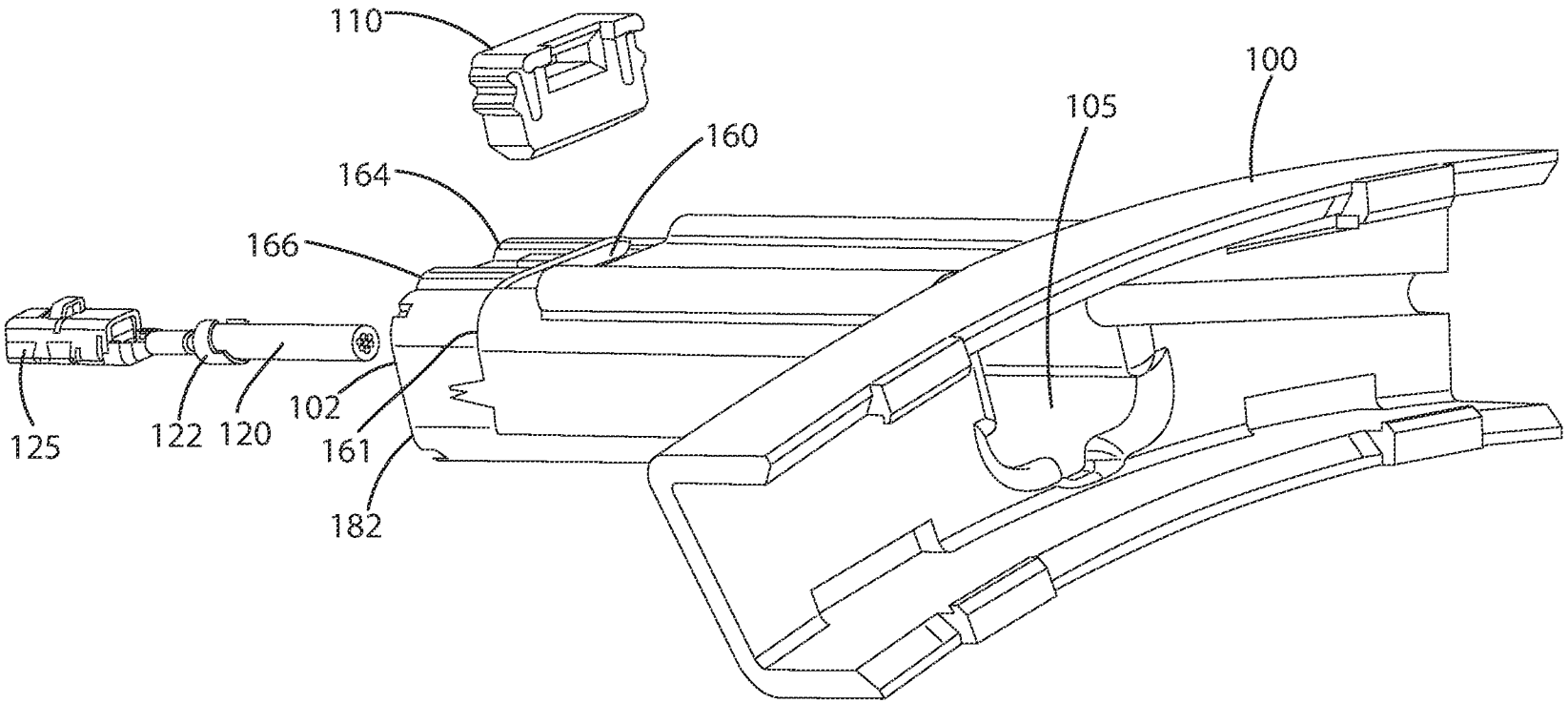
FIG. 2G is an exploded perspective view of the female connector of FIG. 2A and its components, in accordance with the principles of the present invention.

FIG. 2G is an exploded perspective view of the female connector of FIG. 2A and its components, in accordance with the principles of the present invention. FIG. 2G shows an aperture 105 near the top of the female connector 100, and shows the female TPA 110. A wire 120 for the female connector 100, an electrical crimp 122 for the female connector 100, and a terminal box 125 for the female connector 100 are additionally shown in FIG. 2G.

FIGS. 2F and 2G show features near the top of the female connector 100, including fastening clips. One or more of these features can be used to fasten the female connector 100 with a body (not shown).

Figure 2H:
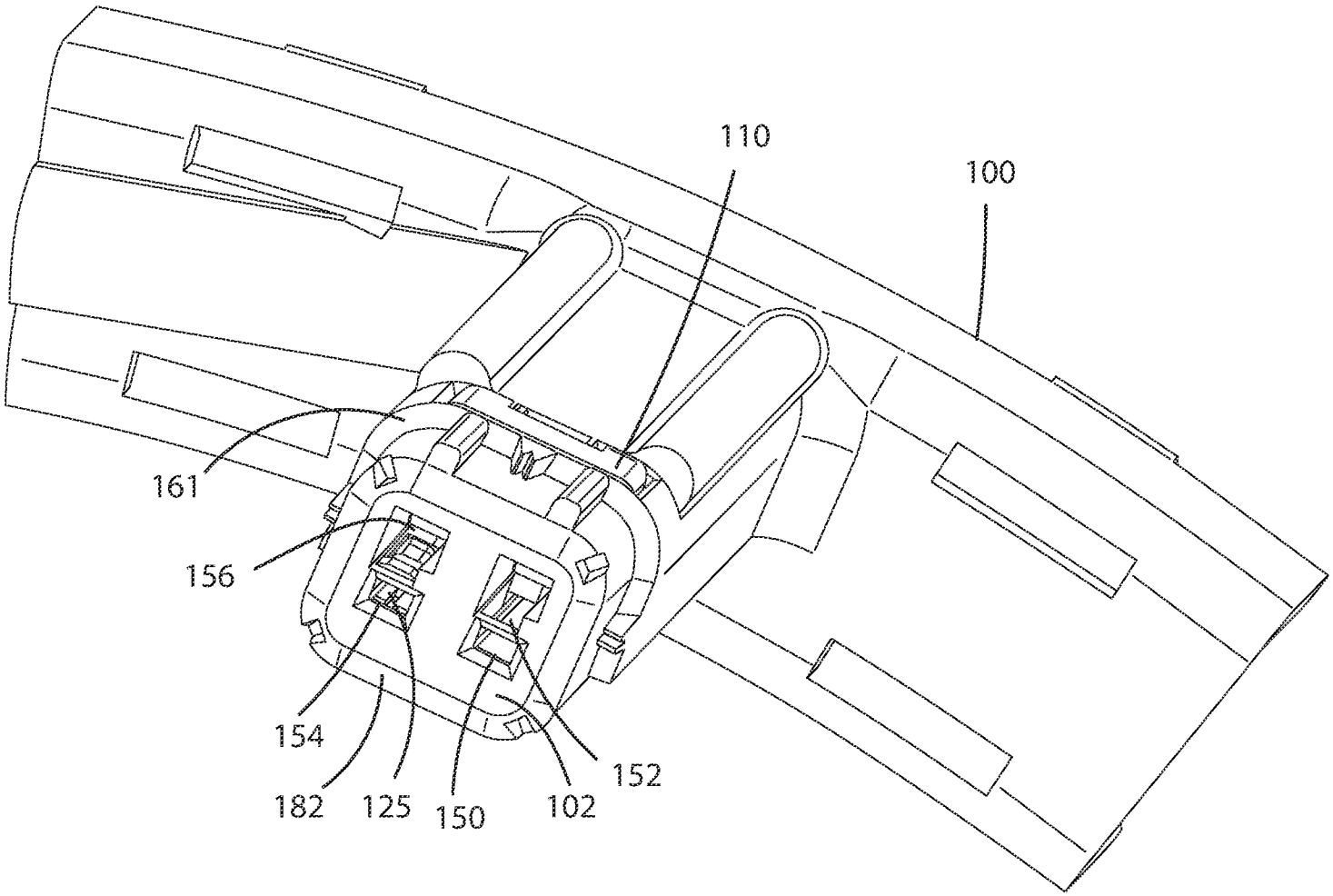
FIG. 2H is a perspective view of the female connector of FIG. 2A and its components, in accordance with the principles of the present invention.
Figure 2I:
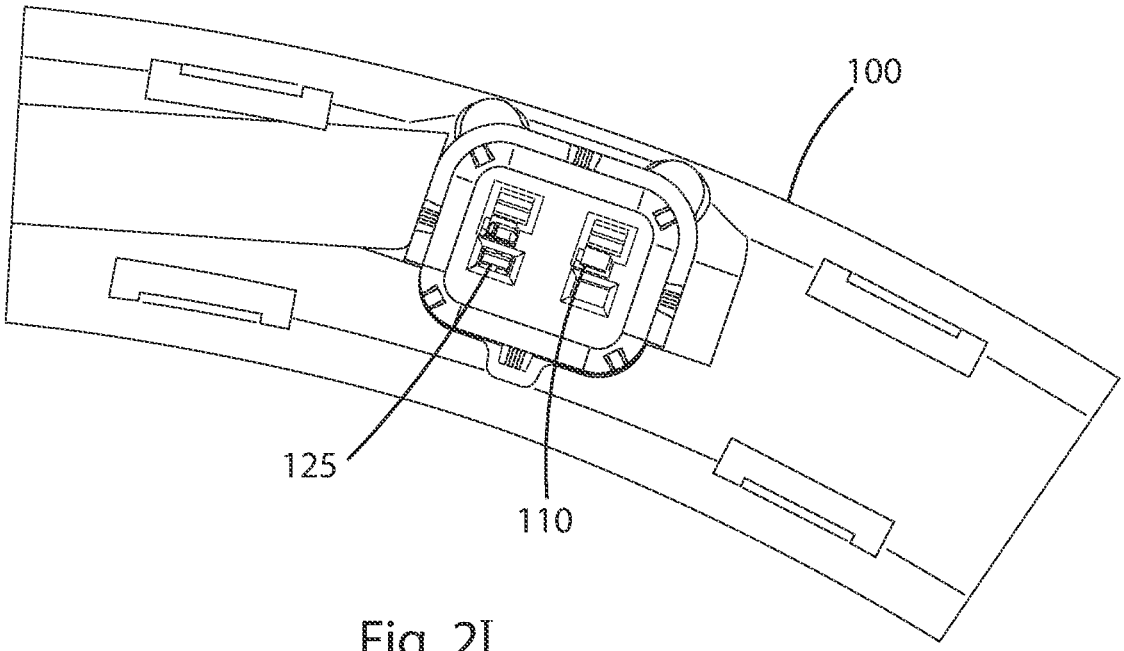
FIG. 2I is a bottom end elevational view of the female connector of FIG. 2A and its components, in accordance with the principles of the present invention.

FIG. 2H is a perspective view of the female connector of FIG. 2A and its components, in accordance with the principles of the present invention. FIG. 2I is a bottom end elevational view of the female connector of FIG. 2A and its components, in accordance with the principles of the present invention.

Figure 3A:
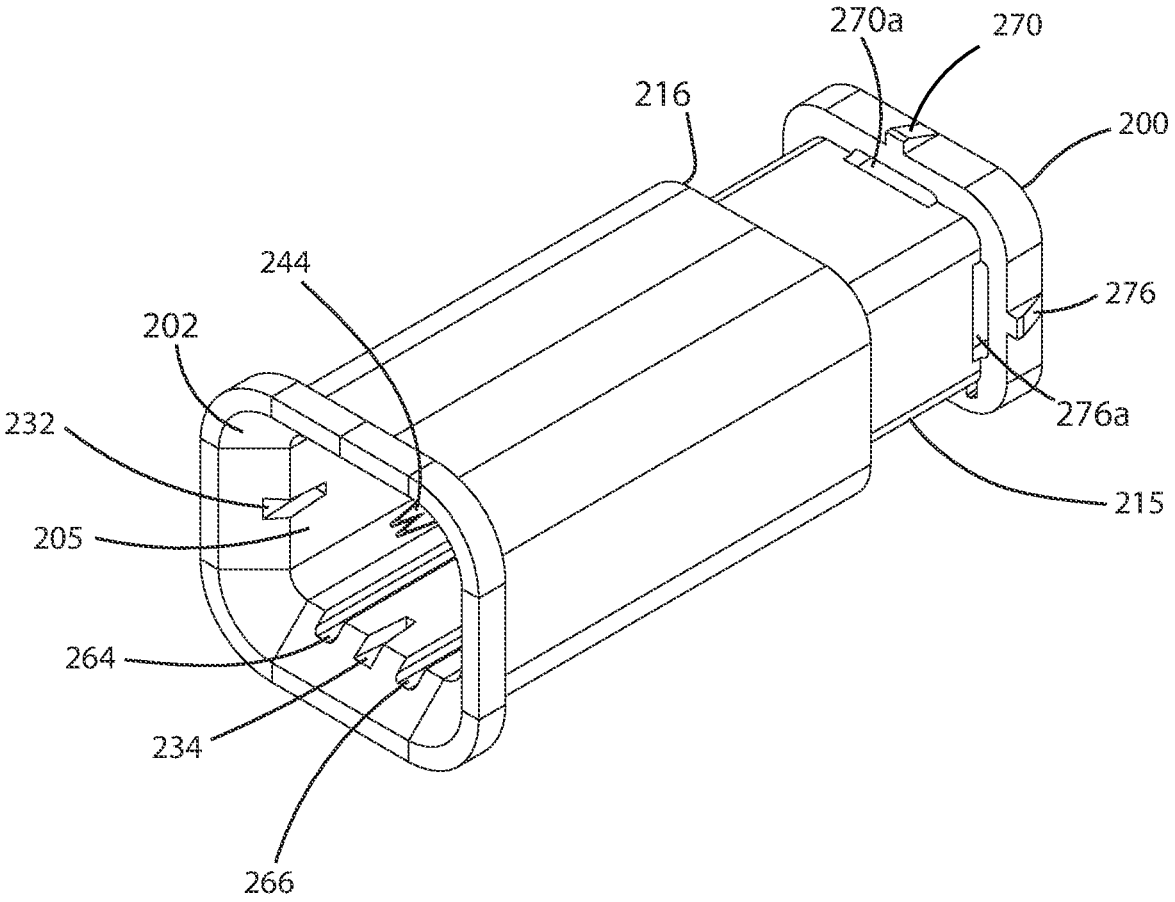
FIG. 3A is a perspective view of a male inner housing, in accordance with the principles of the present invention.

FIG. 3A is a perspective view of a male inner housing, in accordance with the principles of the present invention. FIG. 3A shows an aperture 205 at the top of the male inner housing 200 for receiving the bottom of the female connector 100, and also shows the fork-shaped protrusion 244 and the fork-receiving apertures 232 and 234.

The male inner housing 200 has a back interior wall having the fork-receiving aperture 234 for receiving the fork-shaped protrusion 134 of the female connector 100. The back interior wall of the male inner housing 200 also accommodates the bottom surface 102 of the female connector 100 in its entirety and the bottom surface 102 will abut, sit flush, and make complete uniform contact with the back interior wall of the male inner housing 200 when fully inserted (see, FIG. 8B, 12). The back interior wall also has an alignment groove 264 for receiving the alignment protrusion 164 of the female connector 100, and an alignment groove 266 for receiving the alignment protrusion 166 of the female connector 100. The alignment grooves 264, 266 and alignment protrusions 164, 166 help to ensure that the female connector 100 is inserted properly into the male inner housing 200 with the correct orientation and alignment.

FIG. 3A shows a ramp 270 and a ramp 276 near the bottom of the male inner housing 200. FIG. 3A also shows a notch 215 to accommodate the ledge 440 of the male outer housing 400. The notch 215 is near the bottom of the male inner housing 200. The ledge 440 is shown in FIGS. 5B and 5C, for example.

Figure 3B:
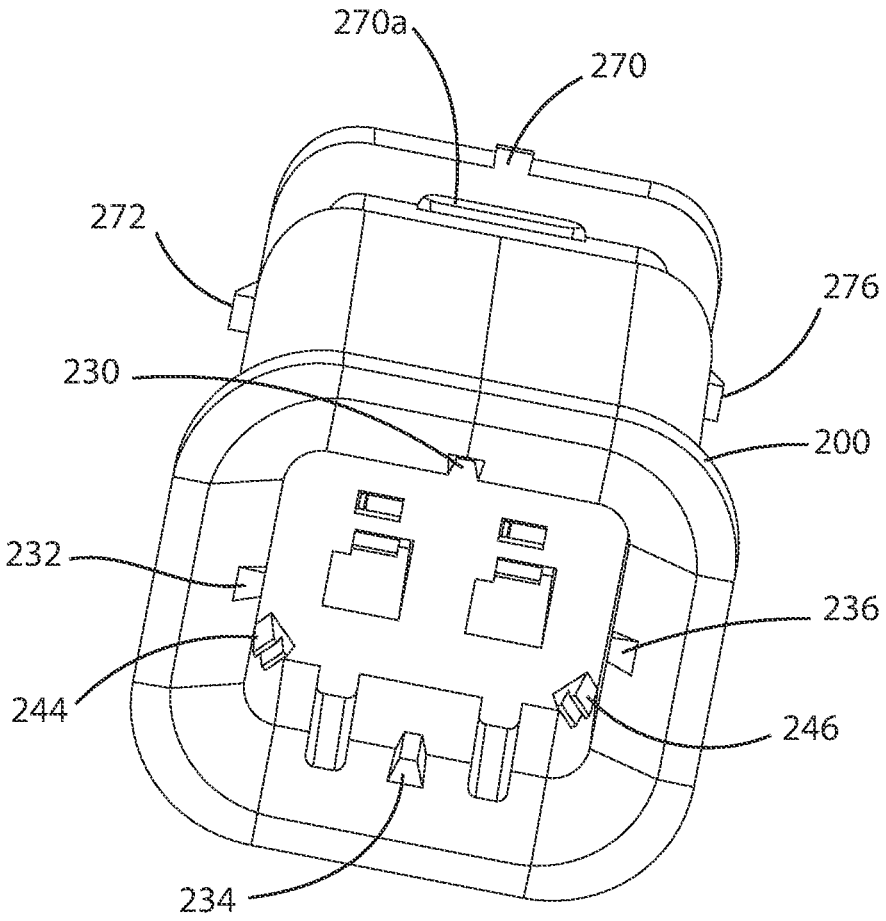
FIG. 3B is a perspective view of the male inner housing of FIG. 3A.
Figure 3C:
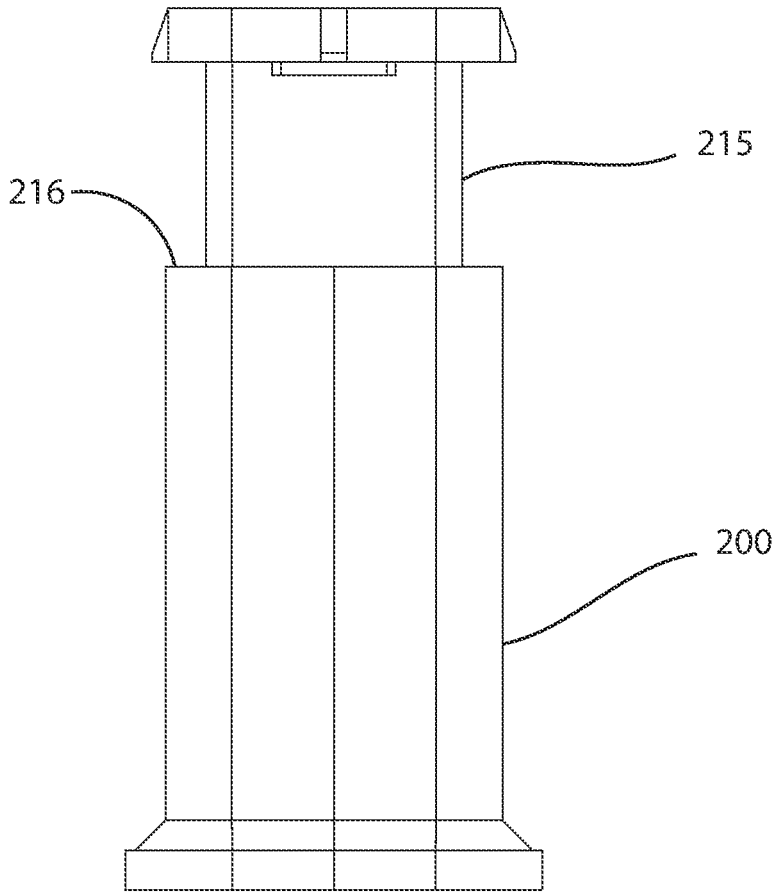
FIG. 3C is a front elevational view of the male inner housing of FIG. 3A.

FIG. 3B is a perspective view of the male inner housing of FIG. 3A. FIG. 3B shows ramps 270, 272, and 276, fork-receiving apertures 230, 232, 234, and 236, and fork-shaped protrusions 244 and 246. FIG. 3C is a front elevational view of the male inner housing of FIG. 3A.

Figure 3D:
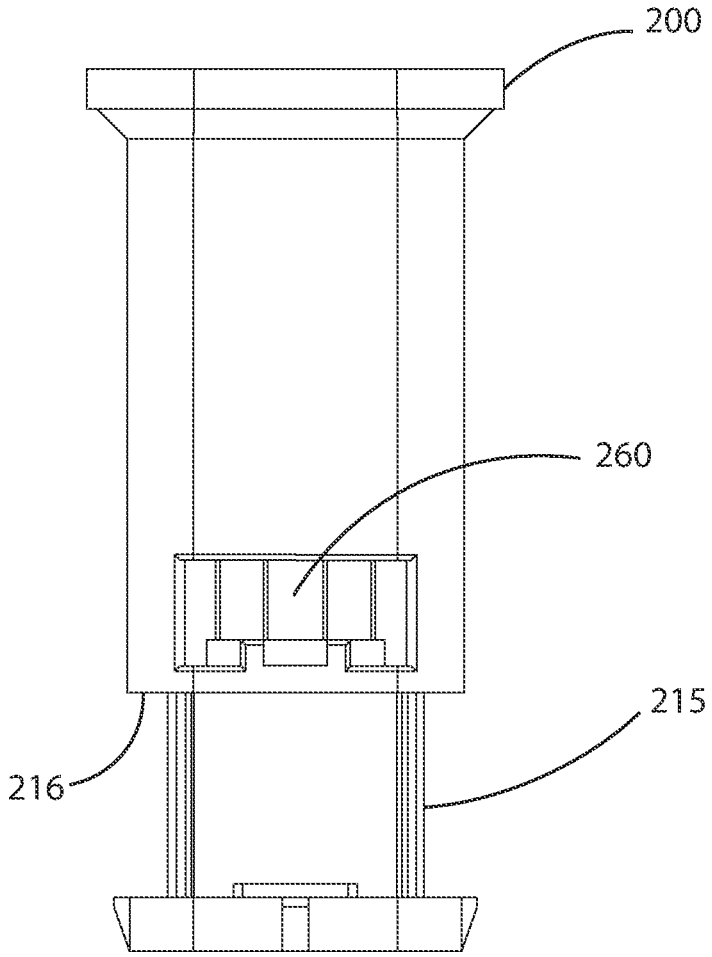
FIG. 3D is a back elevational view of the male inner housing of FIG. 3A.

FIG. 3D is a back elevational view of the male inner housing of FIG. 3A. FIG. 3D shows that the back of the male inner housing 200 has an aperture 260 for receiving the male terminal position assurance (TPA) member 210. As shown in FIG. 3D, the bottom of the male inner housing 200 has a platform 218 immediately below the notch 215. The platform 218 is wider than the notch 215, as shown in FIG. 3D. The bottom of the male inner housing 200 can be referred to as a bottom end of the male inner housing 200.

Figure 3E:
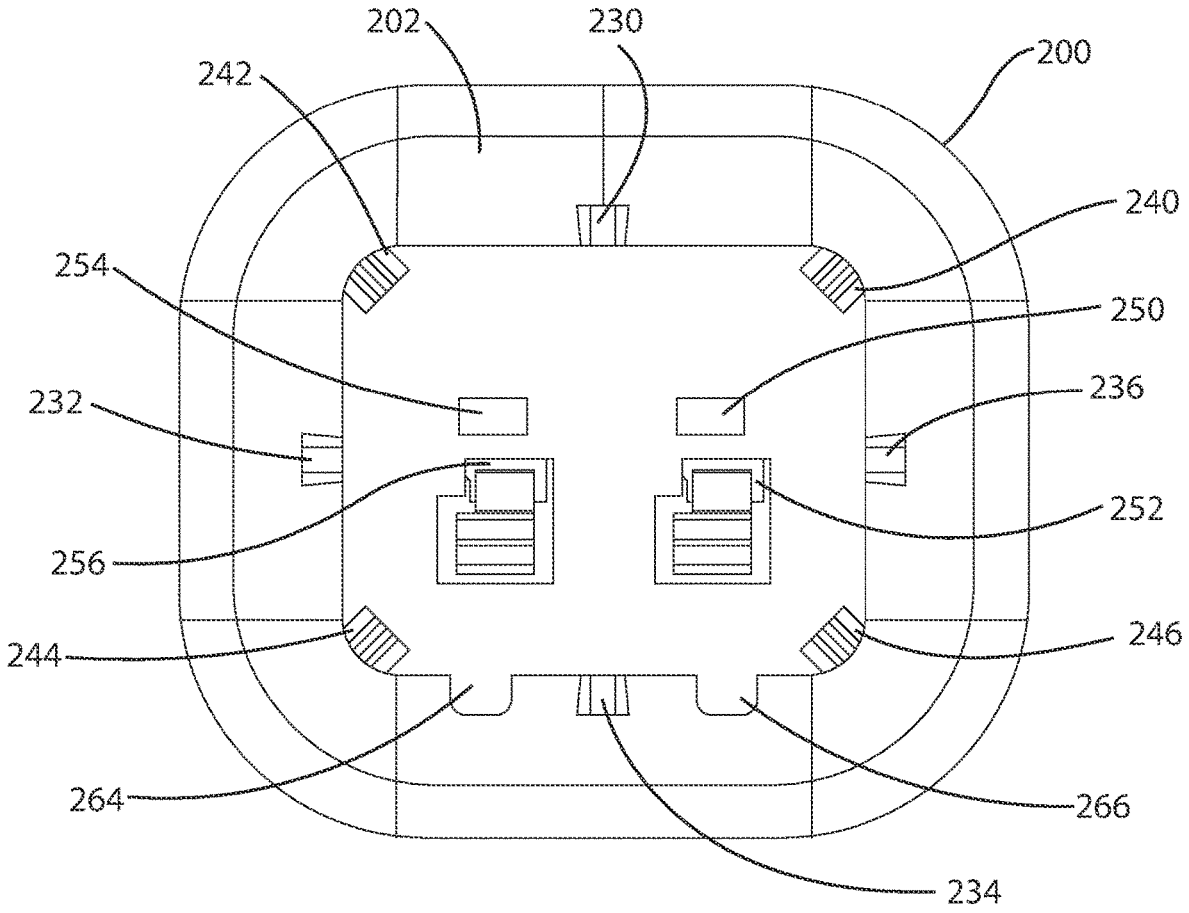
FIG. 3E is a top end elevational view of the male inner housing of FIG. 3A.

FIG. 3E is a top end elevational view of the male inner housing of FIG. 3A. The male inner housing 200 includes fork-shaped protrusions 240, 242, 244, and 246 as shown in FIG. 3E. Also, the male inner housing 200 has the fork-receiving aperture 230 on a front interior wall, fork-receiving aperture 232 on a left side interior wall, fork-receiving aperture 234 on a back interior wall, and fork-receiving aperture 236 on a right side interior wall. The apertures 250, 252, 254, and 256 are on the bottom of the male inner housing 200. The alignment grooves 264 and 266 are on the back interior wall.

Figure 3F:
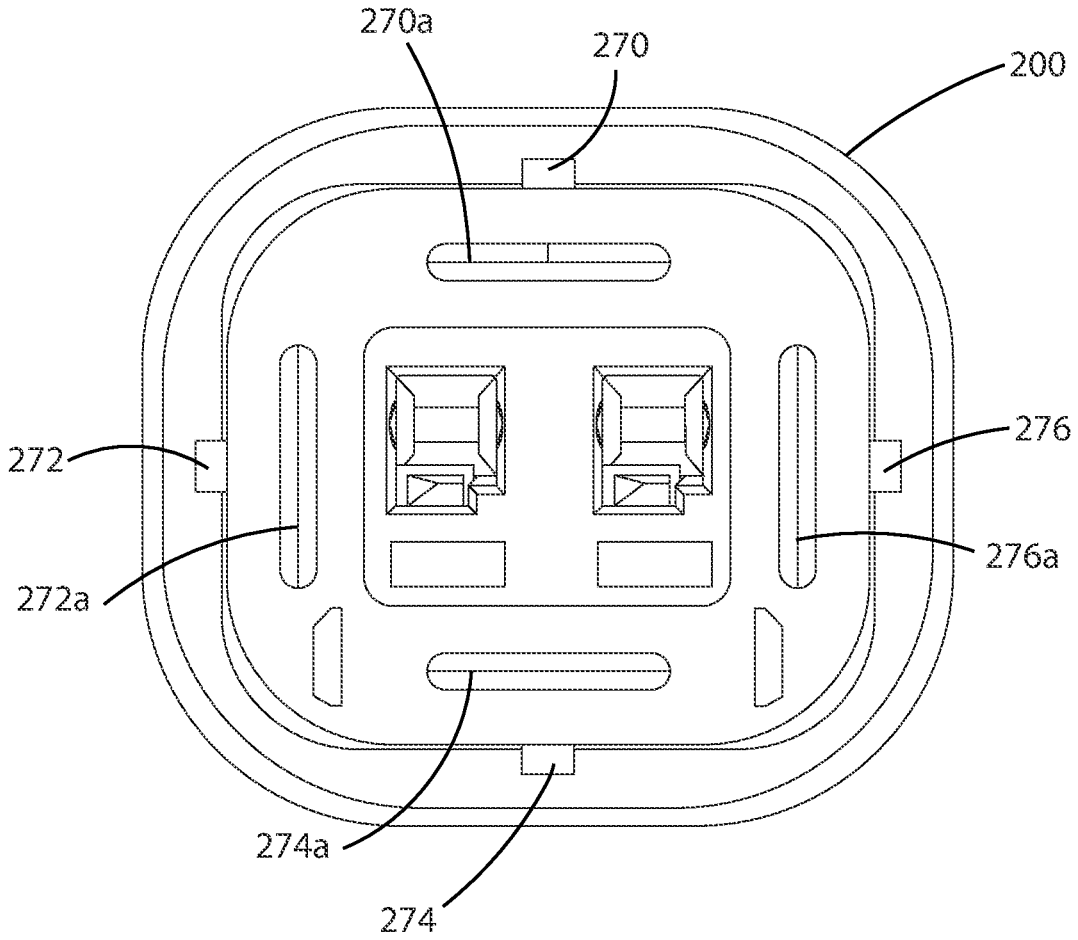
FIG. 3F is a bottom end elevational view of the male inner housing of FIG. 3A.

FIG. 3F is a bottom end elevational view of the male inner housing of FIG. 3A. FIG. 3F shows ramps 270, 272, 274, and 276 on the male inner housing 200. The ramps 270, 272, 274, and 276 are near the bottom of the male inner housing 200.

The platform 218 is on the bottom of the male inner housing 200. Each side of the platform 218 has a respective one of the ramps 270, 272, 274, and 276. Each one of the respective ramps 270, 272, 274, and 276 is substantially centrally located on its side of the platform 218, as shown in FIG. 3F.

Figure 3G:
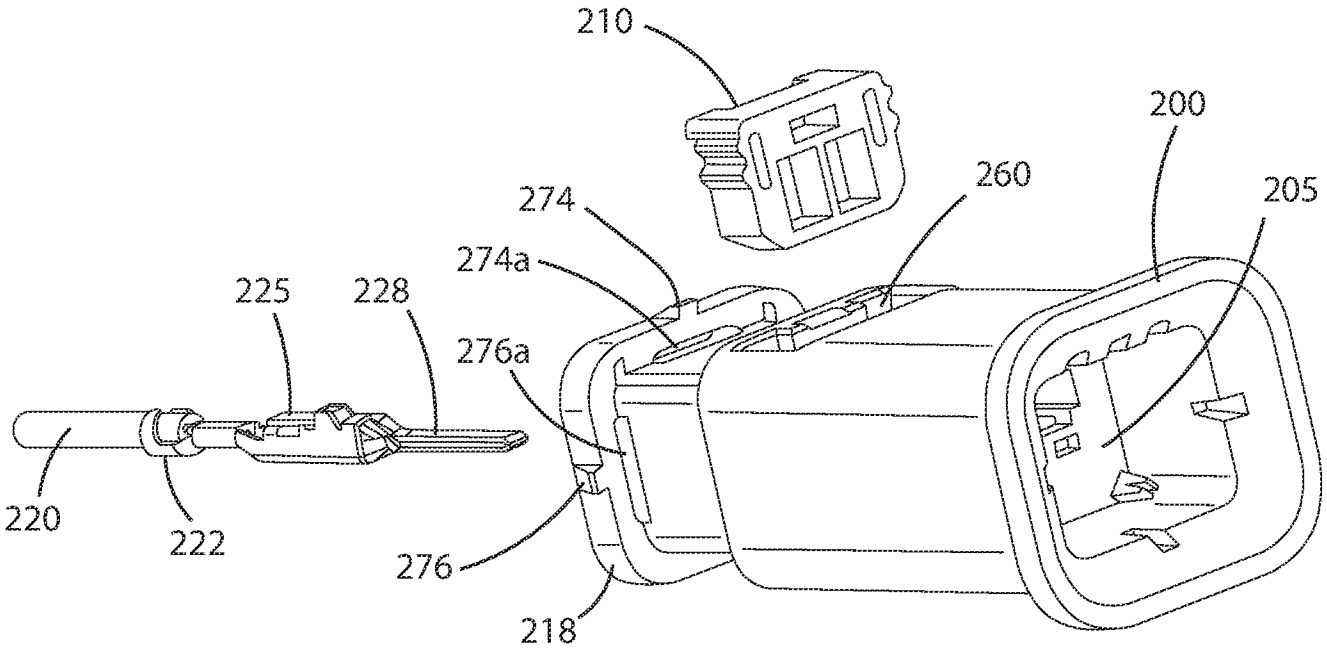
FIG. 3G is an exploded perspective view of the male inner housing of FIG. 3A and its components, in accordance with the principles of the present invention.
Figure 3H:
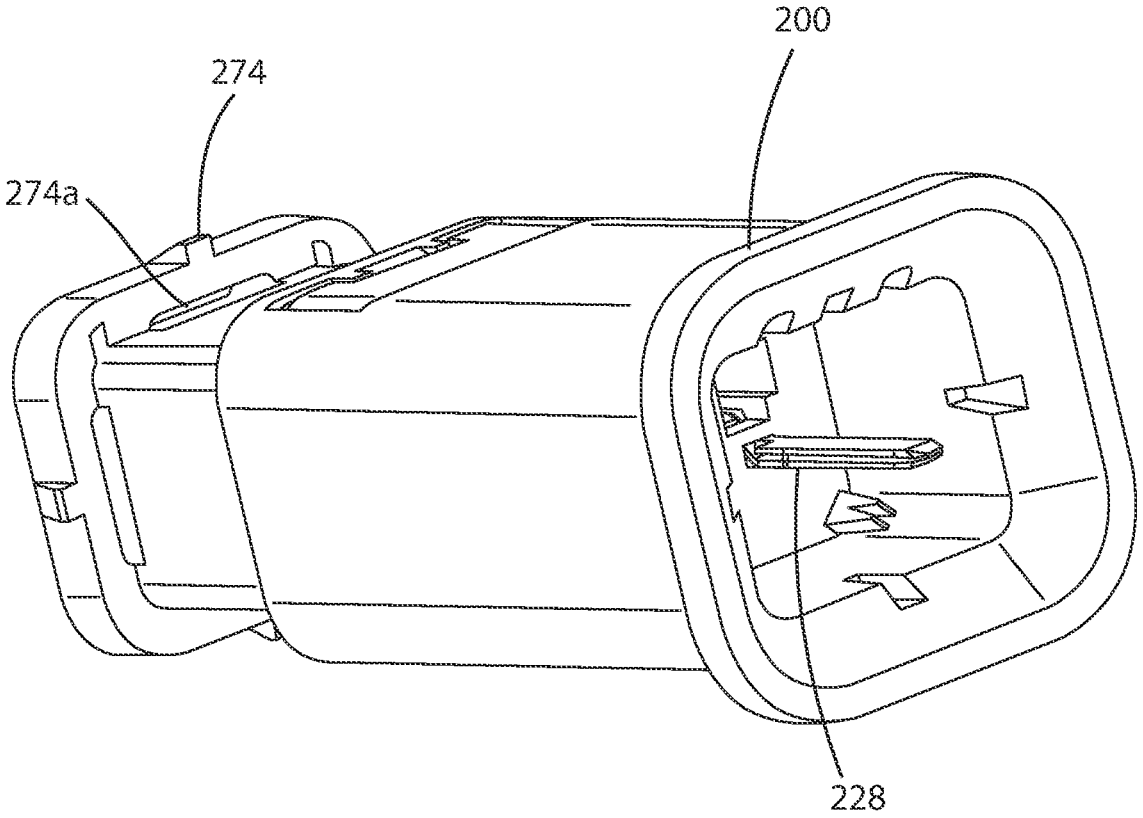
FIG. 3H is a perspective view of the male inner housing of FIG. 3A and its components, in accordance with the principles of the present invention.

FIG. 3G is an exploded perspective view of the male inner housing of FIG. 3A and its components, in accordance with the principles of the present invention. An electrical wire 220, electrical crimp 222, terminal box 225, and blade 228 are shown in FIG. 3G. FIG. 3H is a perspective view of the male inner housing of FIG. 3A and its components, in accordance with the principles of the present invention.

When the male inner housing 200 is coupled with, or mated with, the female connector 100, the bottom of the female connector 100 penetrates the aperture 205 and the blade 228 penetrates the terminal box 125. When the blade 228 penetrates the terminal box 125, there is an electrical connection between the male inner housing 200 and the female connector 100.

Figure 3I:
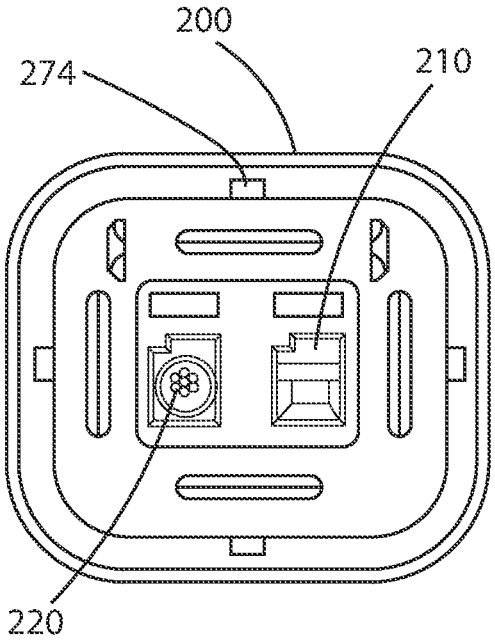
FIG. 3I is a bottom end elevational view of the male inner housing of FIG. 3A and its components, in accordance with the principles of the present invention.

FIG. 3I is a bottom end elevational view of the male inner housing of FIG. 3A and its components, in accordance with the principles of the present invention.

Figure 4A:
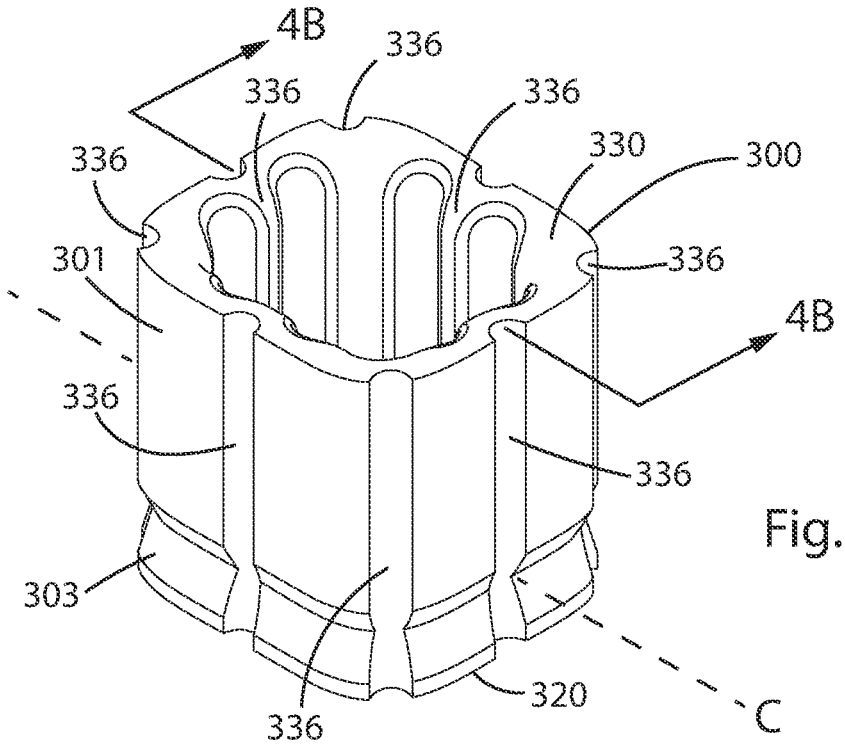
FIG. 4A is a perspective view of a suspension, in accordance with the principles of the first embodiment of the present invention.

FIG. 4A is a perspective view of a suspension, in accordance with the principles of the first embodiment of the present invention. FIG. 4A shows the suspension 300 which is flexible and elastic. The suspension 300 is elastomeric and can be made of a synthetic material, a natural material, or a combination of synthetic and natural materials. Here, the suspension 300 is made from a from silicone rubber, The shown embodiment here is one molded integral piece which has two regions, an upper region 301 and lower region 303.

The suspension 300 resiliently urges the male inner housing 200 in all degrees of freedom utilizing the resiliency of the lower portion 303 and the cushioning resilient features 336. The male inner housing 200 is urged to remain positioned such that the center axis of the male inner housing 200 is aligned with the center axis of the male outer housing 400. Also, if the male inner housing 200 is ever pushed so that the center axis of the male inner housing 200 is temporarily not aligned with the center axis of the male outer housing 400, the suspension 300 resiliently urges the male inner housing 200 to move in a manner such that the center axis of the male inner housing 200 again becomes aligned with the center axis of the male outer housing 400.

The center axis of the male inner housing 200 extends through the male inner housing 200 along a left-to-right, lengthwise direction when viewing FIG. 8B, for example. The center axis of the male outer housing 400 extends through the male outer housing 400 along a left-to-right lengthwise direction when viewing FIG. 8B, for example. The center axis of the connector system extends through the female connector 100, male inner housing 200, suspension 300, and male outer housing 400, along a left-to-right direction when viewing FIG. 8B, for example.

The male inner housing 200 could be pushed in a manner such that the center axis of the male inner housing 200 is temporarily not aligned with the center axis of the male outer housing 400, during an attempted coupling of the female connector 100 and the male inner housing 200, for example. That is, a user moving the bottom of the female connector 100 toward the aperture 205 could inadvertently push a portion of the top of the male inner housing 200 sideways (please see FIGS. 1C and 11) instead of inserting the bottom of the female connector 100 straight down directly into the aperture 205 without any contact that creates sideways movement of the male inner housing 200. In other words, if a user is attempting to insert the bottom of the female connector 100 downward into the aperture 205 of the male inner housing 200 (please see FIGS. 1C and 11), but the user is not aiming or aligning the female connector 100 perfectly, the bottom of the female connector 100 would not be initially correctly aligned with the aperture 205 of the male inner housing 200 and therefore could push the male inner housing 200 such that the center axis of the male inner housing 200 is temporarily not aligned with the center axis of the male outer housing 400. In such a situation, the flexibility of the suspension 300 permits the male inner housing 200 to move such that the center axis of the male inner housing 200 is temporarily not aligned with the center axis of the male outer housing 400 during an attempted coupling of the aperture 205 with the bottom of the female connector 100 wherein a tapered lead-in 202 may or will additionally redirect the female towards the center axis of the male inner housing when contact is made with a said portion of the tapered lead-in 202. Also, the elasticity of the suspension 300 causes the male inner housing 200 either. (1) to move back to a position such that the center axis of the male inner housing 200 is again aligned with the center axis of the male outer housing 400 after the coupling of the aperture 205 with the bottom of the female connector 100 has been completed, or (2) to be urged to move back to a position such that the center axis of the male inner housing 200 is aligned with the center axis of the male outer housing 400 after the coupling of the aperture 205 with the bottom of the female connector 100 has been completed.

The suspension 300, the shape of the tapered lead-in 202 of the top of the male inner housing 200, and the shape of the aperture 205 can help a user to quickly and easily insert the bottom of the female connector 100 into and further insert into the aperture 205 even when the user is not able to visually confirm the precise location of the aperture 205.

The suspension 300 can act as a shock absorber if a user pushes the bottom of the female connector 100 into the aperture 205 with an excessive amount of force or if forces in the lengthwise, vertical direction, impact the female connector 100 and male inner housing 200 which are fully assembled while the male inner housing 200 is suspended by the suspension 300. That is, the flexibility of the suspension 300 and the suspension 300A permit the bottom of the female connector 100 to move the male inner housing 200 downward while the male outer housing 400 remains substantially motionless. Please see FIGS. 11 and 12 and below discussion for the relative movements of the female connector 100, male inner housing 200, and male outer housing 400 during assembly of the connector system.

With reference to FIGS. 1C, 11, and 12, the elasticity of the suspension 300 and suspension 300A causes the male inner housing 200 either: (1) to move upwards towards the top of the female connector 100 (while the male outer housing 400 remains substantially motionless) after the coupling of the aperture 205 with the female connector 100 has been completed and the bottom surface 102 abuts the back interior wall of the male inner housing 200, or (2) to be urged to move upwards toward the top of the female connector 100 (while the male outer housing 400 remains substantially motionless) after the coupling of the aperture 205 with the female connector 100 has been completed and the bottom surface 102 abuts the back interior wall of the male inner housing 200, this urging is provided by a spring like force accomplished by an upper edge 330, main body 332 and lower edge 334 as will be discussed below.

Figure 4B:
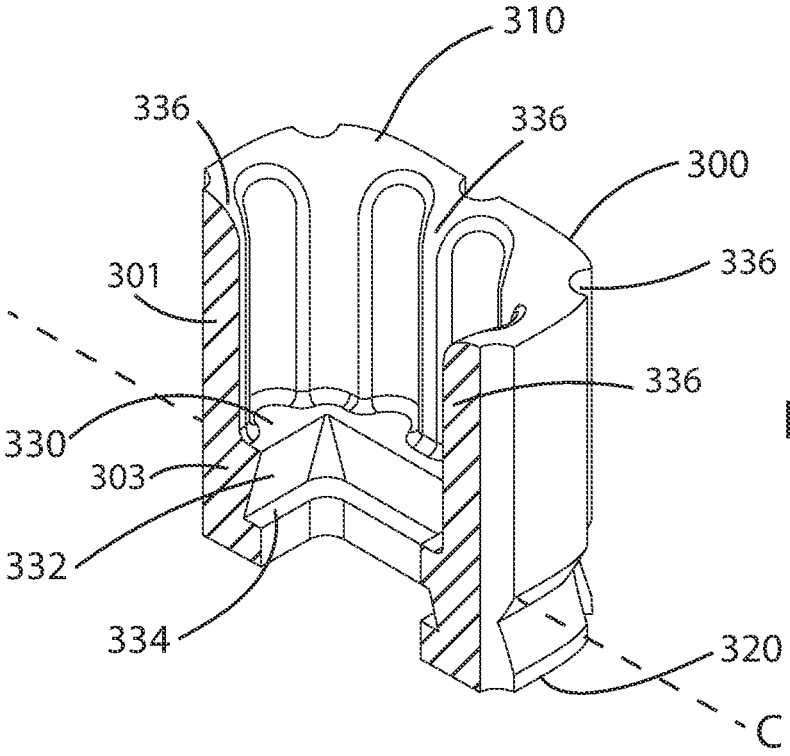
FIG. 4B is a cross-sectional view, taken along line 4B-4B in FIG. 4A.
Figure 4C:
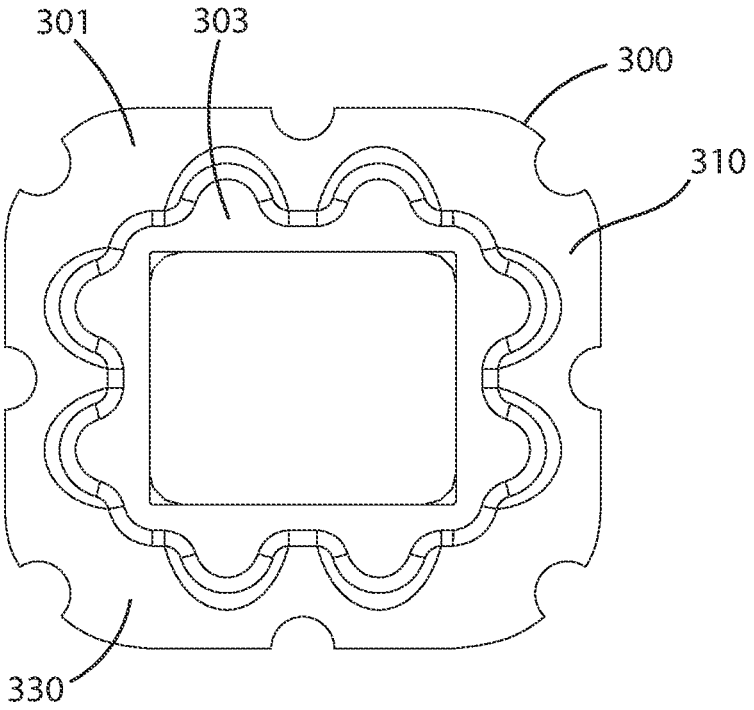
FIG. 4C is a top end elevational view of the suspension of FIG. 4A.
Figure 4D:
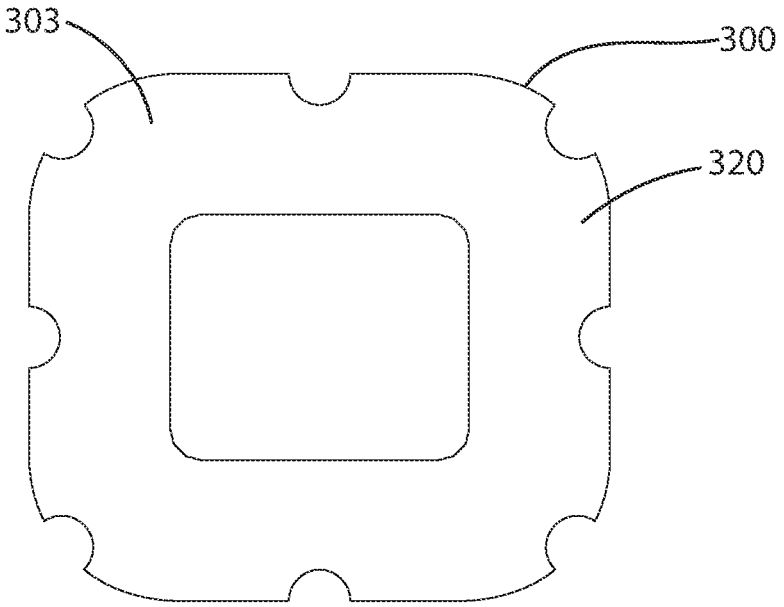
FIG. 4D is a bottom end elevational view of the suspension of FIG. 4A.

FIG. 4B is a cross-sectional view, taken along line 4B-4B in FIG. 4A. FIG. 4B shows a top 310 and a bottom 320 of the suspension 300. On the interior of the suspension 300, there is a ramp type portion having the upper edge 330, a main body 332, and a lower edge 334. When the connector system is assembled, at least a portion of the upper edge 330 is abutting a top surface 216 of the notch 215 of the male inner housing 200. The top surface 216 of the notch 215 is acted upon by the upper edge 330 of the suspension 300, 300A when the suspension 300, 300A is acting as a spring type device in operation. FIG. 4C is a top end elevational view of the suspension of FIG. 4A. FIG. 4D is a bottom end elevational view of the suspension of FIG. 4A.

When a user pushes the female connector 100 so that the bottom of the female connector 100 goes all the way into the aperture 205, the top surface 216 of the notch 215 of the male inner housing 200 can engage with the upper edge 330 of the suspension 300 (or with the upper edge 330 of the suspension 300A (second embodiment)). The elasticity of the upper edge 330 permits the male inner housing 200 to move further down and traverse into the male outer housing 400 while the male outer housing 400 remains relatively motionless. The upper edge 330 provides resilience to this motion and acts like and provides a spring like force in combination with the main body 332 and lower edge 334. The angled portion of the main body 332 formed with the lower edge 334 and upper edge 330 creates a substantially a Z-shaped structure.

As shown in FIGS. 4B, 4C, and 4D, the suspension 300 forms a through-hole in a center area of the suspension 300. As shown in FIGS. 4B, 4C, and 4D, the through-hole in the center of the suspension 300 has a wider opening near the top of the suspension 300 and a narrower opening defined by the upper edge 330 of the ramp near the bottom of the suspension 300. The wider opening near the top of the suspension 300 can be referred to as a top aperture of the suspension 300. The narrower opening near the bottom of the suspension 300 can be referred to as a bottom aperture of the suspension 300.

The suspension 300, as shown in FIGS. 4A and 4B for example, can be created at one time to be one, unified, single component. However, different embodiments are possible to use two or more separate components in place of the single component 300 shown to be cut and separate by a dashed line C.

The lower region 303 of the suspension 300 may also be replaced by a traditional coil spring or the like in any combination of an upper component of an upper region 301 of the suspension 300, the upper component having a surface the coil spring may abut against during use.

For example, the suspension 300 could be replaced by: (1) an upper component of an upper region 301 of the suspension 300 extending from immediately above the upper edge 330 through to the top 310 which would be the same size, shape, and material as the first and second embodiments of the present invention, with reference to FIG. 4B, and (2) a lower component of a lower region 303 of the suspension 300 including the upper edge 330 and extending from the upper edge 330 through to the bottom 320 which would be the same size, shape, and material as the first and second embodiments of the present invention with reference to FIG. 4B.

Also, the suspension 300 could be replaced by: (1) an upper component of the upper region 301 of the suspension 300 extending from immediately above the upper edge 330 through to the top 310, which would be the same size, shape, and material as the first and second embodiments of the present invention with reference to FIG. 4B, and (2) a lower component of the lower region 303 of the suspension 300 including the upper edge 330 and extending from the upper edge 330 through to the bottom 320 which has a different size, shape and material than the upper component.

Also, the suspension 300 could be replaced by: (1) an upper component of an upper region 301 of the suspension 300 extending from immediately above the upper edge 330 through to the top 310 which has a different size, shape and material than the lower component (2) a lower of a lower region of the suspension 300 including the upper edge 330 and extending from the upper edge 330 through to the bottom 320, which would be the same size, shape, and material of the first and second embodiments of the present invention with reference to FIG. 4B.

Figure 5A:
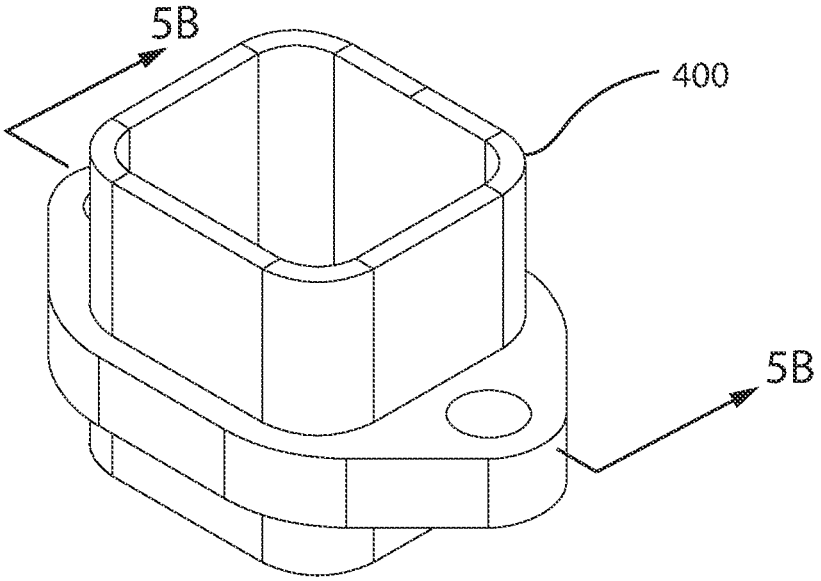
FIG. 5A is a perspective view of a male outer housing, in accordance with the principles of the present invention.
Figure 5B:
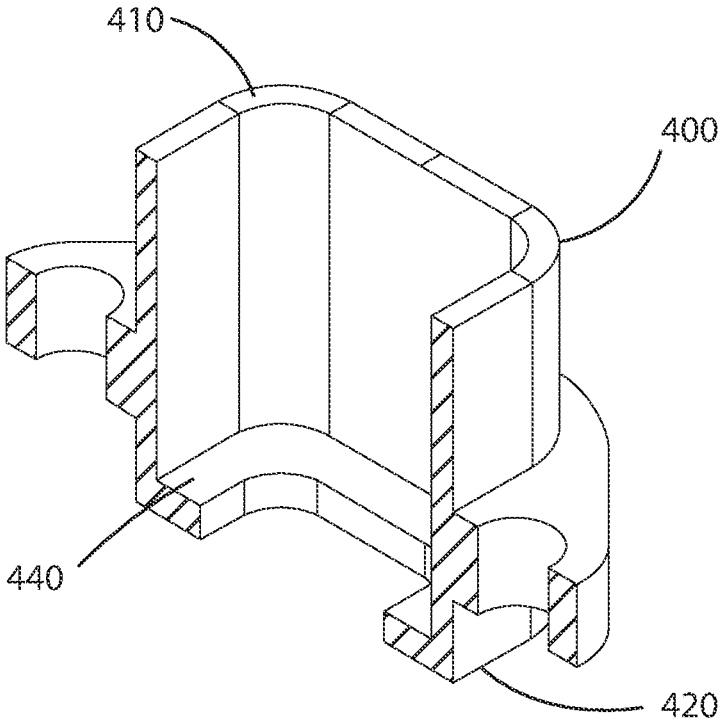
FIG. 5B is a cross-sectional view, taken along line 5B-5B in FIG. 5A.
Figure 5C:
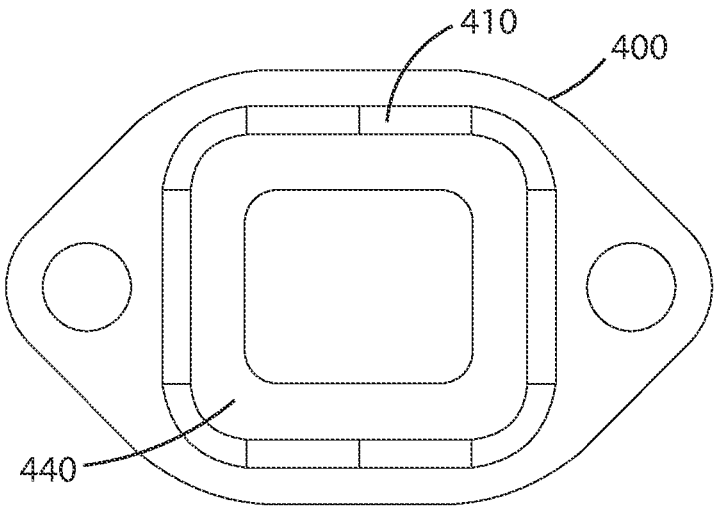
FIG. 5C is a top end elevational view of the male outer housing of FIG. 5A.
Figure 5D:
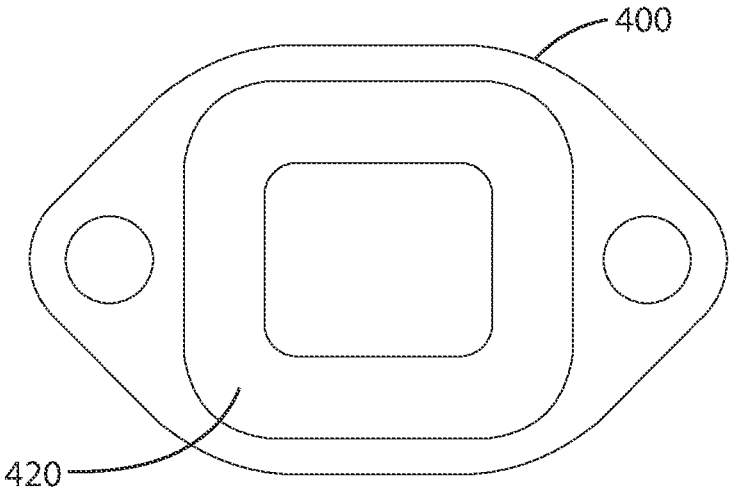
FIG. 5D is a bottom end elevational view of the male outer housing of FIG. 5A.

FIG. 5A is a perspective view of a male outer housing, in accordance with the principles of the present invention. FIG. 5B is a cross-sectional view, taken along line 5B-5B in FIG. 5A. The male outer housing 400 has a top 410 and a bottom 420. FIG. 5C is a top end elevational view of the male outer housing of FIG. 5A. FIG. 5D is a bottom end elevational view of the male outer housing of FIG. 5A.

As shown in FIGS. 5B, 5C, and 5D, the male outer housing 400 has a through-hole formed in a center area of the male outer housing 400. As shown in FIGS. 5B, 5C, and 5D, the through-hole in the center of the male outer housing 400 has a wider opening near the top of the male outer housing 400 and a narrower opening near the bottom of the male outer housing 400. The wider opening near the top of the male outer housing 400 can be referred to as a top aperture of the male outer housing 400. The narrower opening near the bottom of the male outer housing 400 can be referred to as a bottom aperture of the male outer housing 400.

FIGS. 5C and 5D show that the through-hole in the center of the male outer housing 400 has a rounded rectangular shape. FIGS. 5C and 5D also show that the male outer housing 400 has two circular apertures near the edges of the male outer housing 400. The circular apertures are used to mount the male outer housing 400 to a body (not shown).

Figure 6:
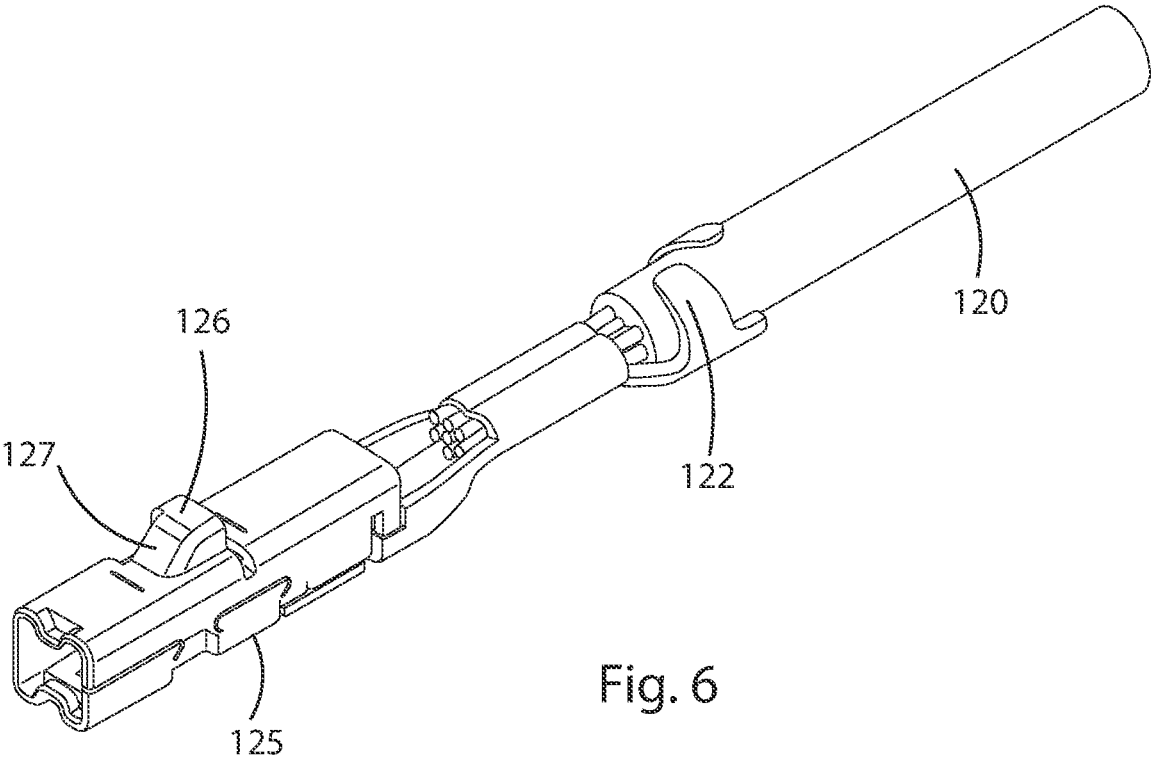
FIG. 6 is a perspective view of the female terminal and its components, in accordance with the principles of the present invention.

FIG. 6 is a perspective view of the female terminal and its components, in accordance with the principles of the present invention. The female terminal is located in the female connector 100. The female terminal includes electrical wire 120, electrical crimp 122, and terminal box 125. The terminal box 125 includes a locking protrusion 126 which has a ramp 127.

Figure 7:
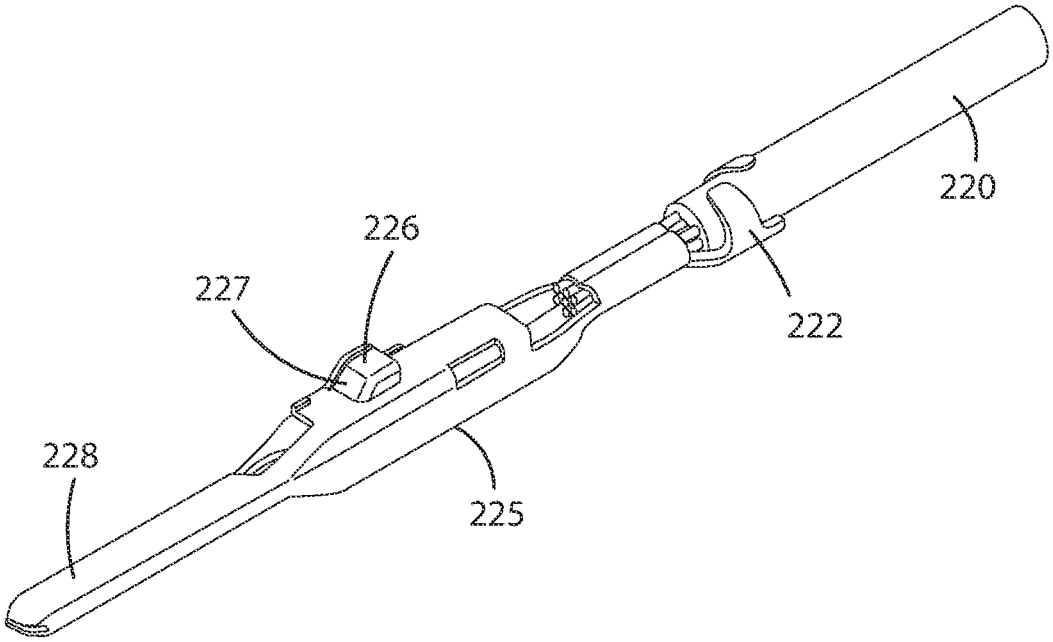
FIG. 7 is a perspective view of the male terminal and its components, in accordance with the principles of the present invention.

FIG. 7 is a perspective view of the male terminal and its components, in accordance with the principles of the present invention. The male terminal is located in the male inner housing 200. The male terminal includes electrical wire 220, electrical crimp 222, and terminal box 225. The terminal box 225 includes a blade 228 and also a locking protrusion 226 which has a ramp 227.

Figure 8A:
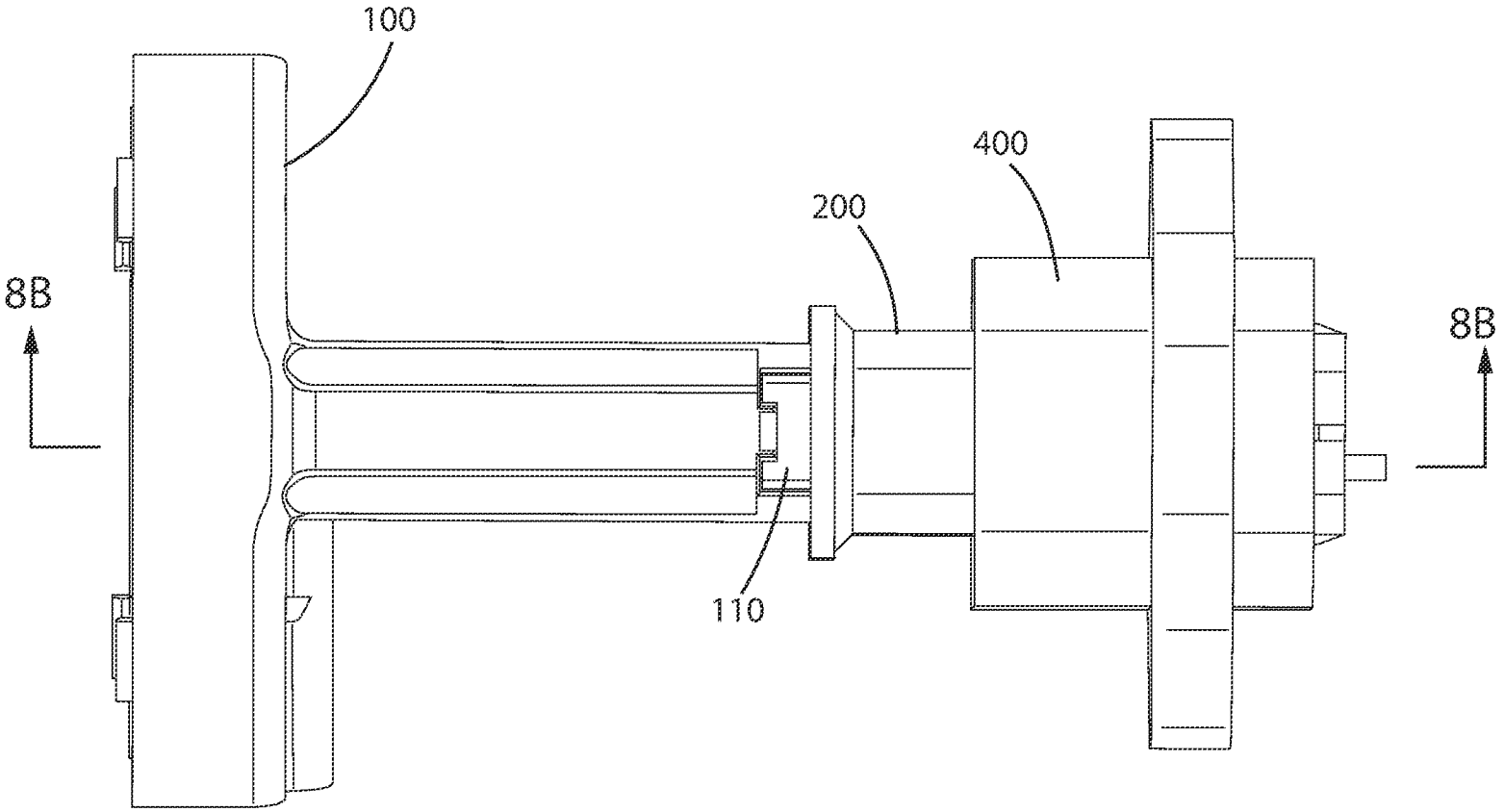
FIG. 8A is a view of the assembled connector system of FIG. 1A.
Figure 8B:
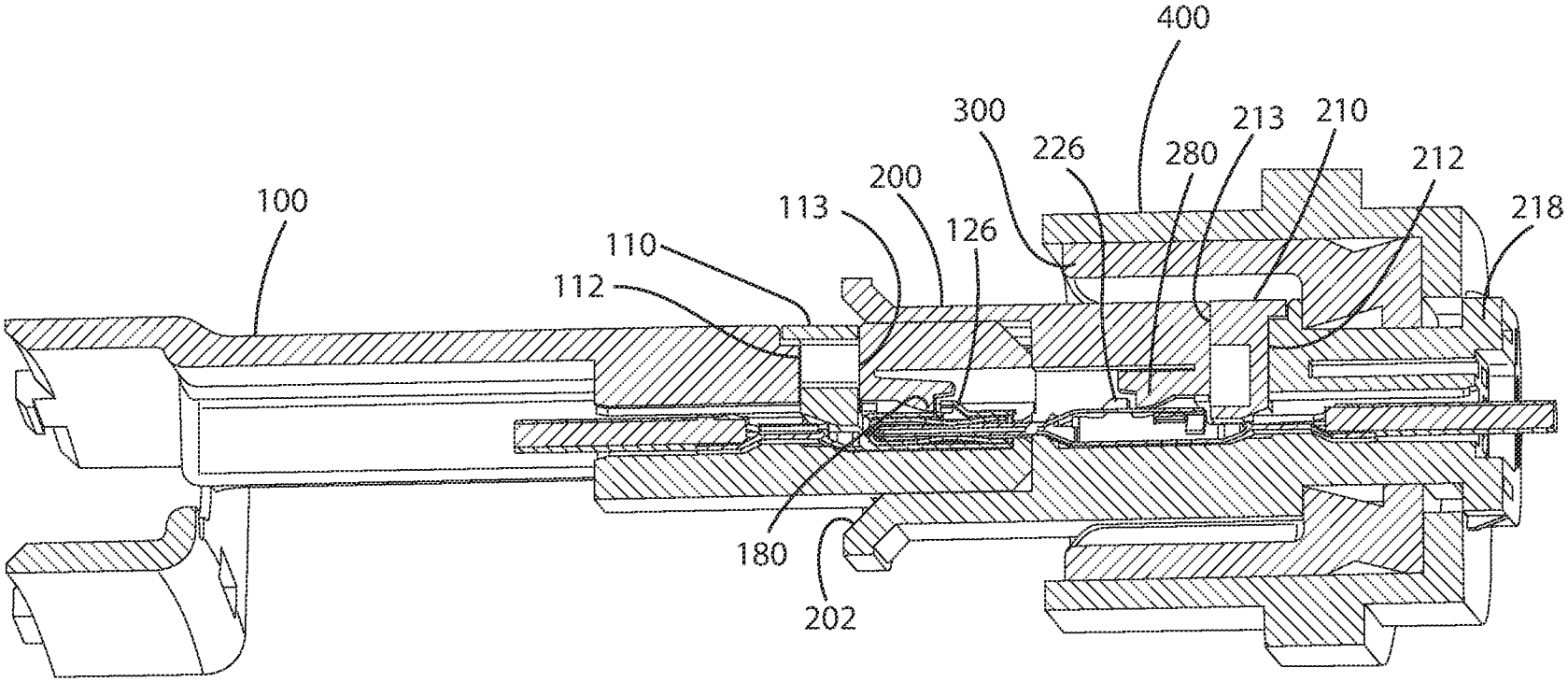
FIG. 8B is a cross-sectional view, taken along line 8B-8B in FIG. 8A.

FIG. 8A is a view of the assembled connector system of FIG. 1A. FIG. 8B is a cross-sectional view, taken along line 8B-8B in FIG. 8A. On the interior of the female connector 100, there is a locking protrusion 180 with a ramp. The locking protrusion 180 engages with the locking protrusion 126 to hold the female terminal in a correct location.

On the interior of the male inner housing 200, there is a locking protrusion 280 with a ramp. The locking protrusion 280 engages with the locking protrusion 226 to hold the male terminal in a correct location.

Figure 9:
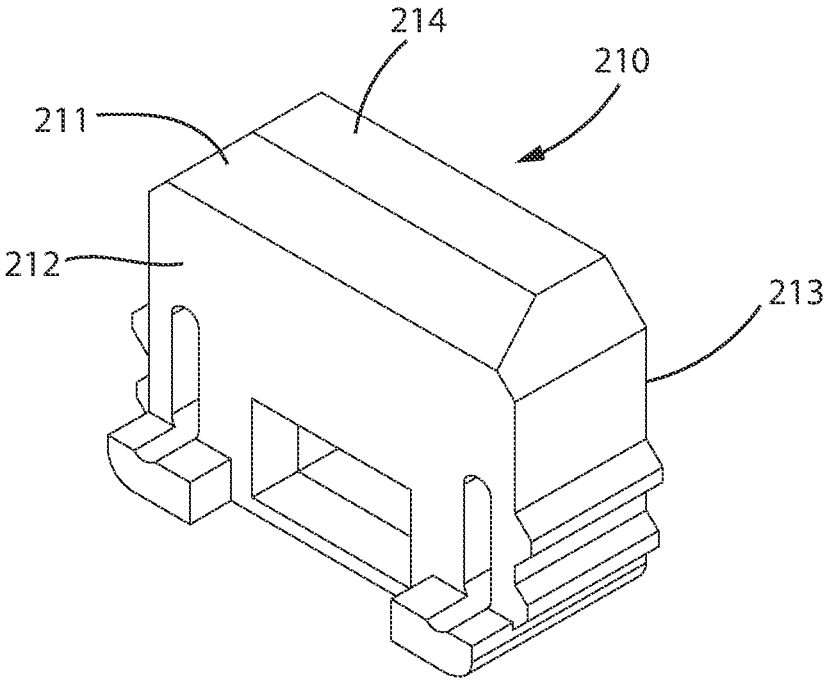
FIG. 9 is a perspective view of a male terminal position assurance member, in accordance with the principles of the present invention.

FIG. 9 is a perspective view of a male terminal position assurance member, in accordance with the principles of the present invention. The male TPA member 210 has a beveled edge 211. The beveled edge 211 accommodates a portion of the male terminal, as shown in FIG. 8B, to ensure a correct position of the male terminal.

After the male TPA member 210 is properly inserted into aperture 260 on the back of the male inner housing 200, the top 213 of the male TPA member 210 faces toward the top of the male inner housing 200, as shown in FIG. 8B. Also, as depicted in FIG. 8B, the top 213 of the male TPA member 210 faces toward the female connector 100. As depicted in FIG. 8B, the front 214 of the male TPA member 210 is facing downwards.

Figure 10:
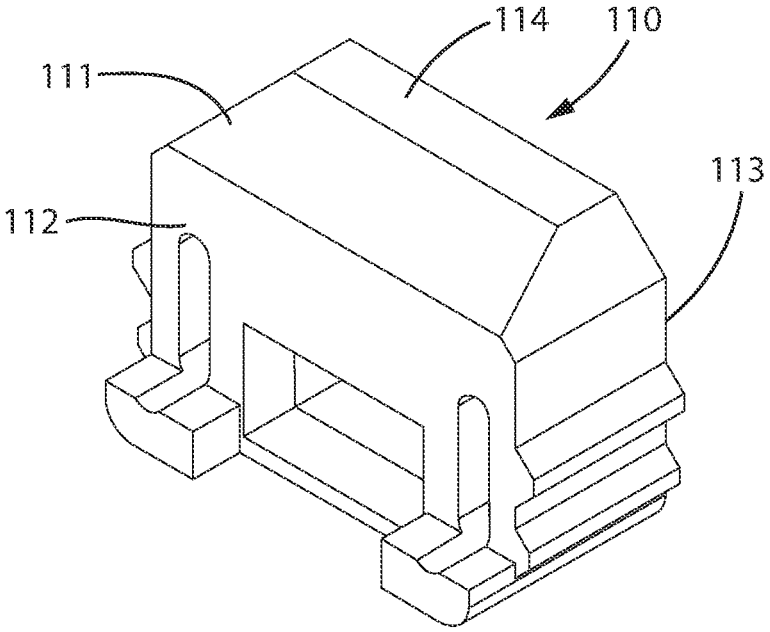
FIG. 10 is a perspective view of a female terminal position assurance member, in accordance with the principles of the present invention.

FIG. 10 is a perspective view of a female terminal position assurance member, in accordance with the principles of the present invention. The female TPA member 110 has a beveled edge 111. The beveled edge 111 accommodates a portion of the female terminal, as shown in FIG. 8B, to ensure a correct position of the female terminal.

After the female TPA member 110 is properly inserted into aperture 160 on the back of the female connector 100, the bottom 113 of the female TPA member 110 faces toward the bottom of the female connector 100, as shown in FIG. 8B. Also, as depicted in FIG. 8B, the bottom 113 of the female TPA member 110 is facing toward the suspension 300. As depicted in FIG. 8B, the front 114 of the female TPA member 110 is facing downwards.

When comparing the male TPA member 210 and the female TPA member 110, please consider the following information. On the male TPA member 210, the beveled edge 211 extends a first distance to connect the front 214 to the bottom 212. On the female TPA member 110, the beveled edge 111 extends a second distance to connect the front 114 to the top 112. As can be seen when comparing FIGS. 9 and 10, the second distance is larger than the first distance.

FIG. 11 is a cross-sectional view of a portion of a connector system, in accordance with the principles of a second embodiment of the present invention, showing a female connector and male connector. FIG. 11 shows suspension 300A (second embodiment), the bottom of the female connector 100, the male inner housing 200, and the male outer housing 400. FIG. 11 indicates the downward movement of the female connector 100 into aperture 205 of the male inner housing 200 during assembly, and also indicates the slight expansion of the aperture 205 when being penetrated by the bottom of the female connector 100.

As shown in FIG. 11, the suspension 300A is shown to have cushioning resilient features 336 horizontally circumventing the upper region 301 of the suspension 300A, above the upper edge 330. The cushioning resilient features 336 are substantially parallel to each other and also parallel to the male inner housing 200 when it is inserted into the suspension 300, 300A.

The suspension 300A (second embodiment) is different from the suspension 300 (first embodiment) at least because of the orientation of the plurality of cushioning resilient features 336. In the suspension 300A, the cushioning resilient features 336 are oriented to be horizontal (please see FIGS. 11 and 12). In the suspension 300, the cushioning resilient features 336 are oriented to be vertical extending between top 310 to upper edge 330 (please see FIGS. 4A, 4B, 4C, 4D, and 8B). The cushioning resilient features 336 are concave inward towards the opening 000 of the suspension 300, 300A when uncompressed by the male inner housing 200.

The bottom of the female connector 100 fits tightly into the aperture 205 at the top of the male inner housing 200. FIG. 11 shows that, when the female connector 100 moves downward into the aperture 205 of the male inner housing 200, and during assembly of the connector system, the top region of the male inner housing 200 (near the aperture 205) may also be forced outward slightly in order to accommodate the bottom of the female connector 100. The bottom of the female connector 100 fits tightly into the aperture 205. Please see FIG. 11. Also seen is the tapered lead-in 202 which may provide a surface to interact with the bottom surface 102, bottom beveled edge 182, and sides of the female connector 100 while entering the aperture 205. The tapered lead-in 202 is substantially funnel shaped and protrudes outward and away from the center axis of the male inner housing 200 and aperture 205 (see, FIG. 11).

FIG. 12 is a cross-sectional view of a portion of a connector system, in accordance with the principles of the second embodiment of the present invention, showing a female connector and male connector.

FIG. 12 shows that, as mating is completed, the suspension 300A is displaced, the cushioning resilient features 336 are compressed, and the male inner housing 200 is pushed downward into the male outer housing 400.

FIG. 12 shows the suspension 300A (second embodiment), the bottom of the female connector 100, the male inner housing 200, and the male outer housing 400. FIG. 12 demonstrates a downward movement of the male inner housing 200 in relation to the male outer housing 400 under the following conditions: (1) initially, it is understood that the female connector 100 is pushed downward a first distance so that the bottom of the female connector 100 is inserted into the aperture 205 of the male inner housing 200 as shown in FIG. 12, (2) subsequently, it is understood that the female connector 100 is pushed downward an additional distance to try to make the bottom of the female connector 100 go deeper into the aperture 205 to ensure full insertion, and (3) because the bottom of the female connector 100 is already fully inserted into the aperture 205, the bottom of the female connector 100 cannot go deeper into the aperture 205, and thus the subsequent pushing of the female connector 100 downward an additional distance causes the top surface 216 of the notch 215 of the male inner housing 200 to compress the upper edge 330 portion of the suspension 300A, allowing the platform 218 of the male inner housing 200 to be moved downward further below the bottom of the male outer housing 400. The suspension 300A provides a resilient force, like a spring, opposite the downward force of the male inner housing 200 during operation, providing an upward force against the female connector 100 as well. Likewise, if preferable and previously mentioned an additional embodiment may utilize a coil spring or the like to substitute the lower portion 303 of the suspension 300, 300A. Essentially, the male inner housing 200 becomes suspended vertically by the lower portion 303. The lower portion 303 spring force resiliently biases the male inner housing 200 towards the female housing 100, inhibiting its further travel downward into the male outer housing 400. This also acts as a type of shock absorption if forces in the lengthwise, vertical direction, impact the female connector 100 and male inner housing 200 which are fully assembled while the male inner housing 200 is suspended by the suspension 300 in operation.

The suspension 300 (first embodiment) functions similarly to the suspension 300A (second embodiment). The suspension 300, 300A has elasticity. The suspension 300, 300A has flexibility. The suspension 300, 300A is relatively more flexible than the inner male housing 200. The suspension 300, 300A is relatively more flexible than the outer male housing 400. The suspension 300, 300A is relatively more flexible than the female connector 100. The inner male housing 200, outer male housing 400, and female connector 100 are substantially inflexible. The flexibility of the suspension is hereby not limited to the above comparisons, the suspension 300, 300A is flexible so that the operation of the lower portion of the suspension 300, 300A is flexible and provides adequate resiliency and spring like force for the secured mating between the female connector 100 and the male inner housing 200 while in use and during operation.

The female connector 100 and its components can include at least the female TPA member 110, wire 120, electrical crimp 122, terminal box 125, and other features described herein. The male connector and its components can include at least the male inner housing 200, suspension 300, male outer housing 400, male TPA member 210, wire 220, electrical crimp 222, terminal box 225, and other features described herein.

It is possible for the bottom aperture of the male outer housing 400 to be forced to be temporarily slightly larger by one or more of the ramps 270, 272, 274, and 276, when the bottom aperture 405 of the male outer housing 400 is being penetrated by the platform 218 during assembly. It is possible for the platform 218 and the ramps 270, 272, 274, and 276, to be temporarily compressed inward by the sides of the bottom aperture 405 of the male outer housing 400, when the bottom aperture of the male outer housing 400 is being penetrated by the platform 218 during assembly. Each side of the platform 218 has a respective one of an apertures 270*a*, 272*a*, 274*a*, and 276*a* are provided in the platform 218 to provide a space for the sides of the platform 218 to compress inward into when the ramps 270, 272, 274, 276, are to be temporarily compressed inward by the sides of the bottom aperture 405 of the male outer housing 400 as mentioned above. Each one of the respective ramps apertures 270*a*, 272*a*, 274*a*, and 276*a* is substantially centrally located on its side of the platform 218, as shown in FIG. 3F.

After the bottom aperture of the male outer housing 400 is penetrated by the platform 218 moving downward, the shape and size of the ramps 270, 272, 274, and 276 prevents the platform 218 from going back up through the bottom aperture 405 of the male outer housing 400. (See FIG. 8B.)

The fork-shaped protrusions 130, 132, 134, 136, 240, 242, 244, and 246 can be referred to as mating protrusions. The fork-receiving apertures 140, 142, 144, 146, 230, 232, 234, and 236 can be referred to as mating apertures. The fork-shaped protrusions and fork-receiving apertures help to reduce vibration and can be referred to as anti-vibration features. The fork-shaped protrusions and fork-receiving apertures fit tightly together.

The female connector 100 can be referred to as a first connector 100. The male connector includes the male inner housing 200, the suspension 300, and the male outer housing 400. The male connector can be referred to as a second connector and is comprised of an in inner housing and an outer housing. The male inner housing 200 can be referred to as the inner housing 200. The male outer housing 400 can be referred to as the outer housing 400.

The bottom of the first connector 100 can be referred to as the first end of the first connector 100. The bottom of the male inner housing 200 can be referred to as the first end of the male inner housing 200.

The foregoing includes a description of the wire 220, crimp 222, terminal box 225, and blade 228 in the male inner housing 200, and also includes a description of the wire 120, crimp 122, and terminal box 125 in the female connector 100. When the male inner housing 200 is coupled with, or mated with, the female connector 100, the bottom of the female connector 100 penetrates the aperture 205 and the blade 228 penetrates the terminal box 125. When the blade 228 penetrates the terminal box 125, there is an electrical connection between the male inner housing 200 and the female connector 100. However, the wire 220, crimp 222, terminal box 225, blade 228, wire 120, crimp 122, and terminal box 125 are not always required. The suspension 300 and other features of the connector system of the subject application still provide benefits, even when there is no electrical connection between the female connector 100 and the male inner housing 200.

As described herein, a blind mate connector system could be wire-to-wire or device-to-device. This blind mate connector system uses an elastomeric suspension to provide compliance for mating alignment and to provide an axial compression force of the two connector halves (such as, for example, a first connector half including the female connector 100, and a second connector half including the male inner housing 200, suspension 300, and male outer housing 400). The features of this blind mate connector system can use a fixed first connector half (female) rigidly mounted to a large body (such as a transmission housing cover, for example) and second connected half (male) that comprises a rigidly mounted outer housing with elastomeric suspension element(s) that suspend an inner connector housing. The outer housing could be mounted to another large body (such as a transmission housing, for example) in such a way that the mating process of the two connector halves might not be observable. The axial compression force of the two connector halves keeps the two contact bearing housings tightly mated to eliminate relative movement between them. The means for mounting and fastening the connector system haves to their respective bodies is not limited herein to the shown structures of this invention.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

LIST OF REFERENCE NUMERALS

100 Female connector (first connector)
102 Bottom Surface
105 Aperture near top side of female connector
110 Female terminal position assurance (TPA) member
111 Beveled edge
112 Top of body of female TPA member
113 Bottom of body of female TPA member
114 Front of body of female TPA member
120 Electrical wire in female connector
122 Electrical crimp
125 Female terminal box
126 Locking protrusion on female terminal box
127 Ramp on locking protrusion
130 Fork-shaped protrusion on front (mating protrusion)
132 Fork-shaped protrusion on left side (mating protrusion)
134 Fork-shaped protrusion on back (mating protrusion)
136 Fork-shaped protrusion on right side (mating protrusion)
140 Fork-receiving aperture (mating aperture)
142 Fork-receiving aperture (mating aperture)
144 Fork-receiving aperture (mating aperture)
146 Fork-receiving aperture (mating aperture)
150 Aperture on bottom
152 Aperture on bottom
154 Aperture on bottom
156 Aperture on bottom
160 Aperture on back of female connector to accommodate female TPA member
161 Beveled Edge of Female Housing
162 Wire routing channel
164 Alignment protrusion
166 Alignment protrusion
180 Locking protrusion (with ramp) on interior of female connector
182 Beveled Edge of Bottom
200 Male inner housing (inner housing)
202 Tapered Lead-in
205 Aperture near top side of male inner housing
210 Male terminal position assurance (TPA) member
211 Beveled edge
212 Bottom of body of male TPA member
213 Top of body of male TPA member
214 Front of body of male TPA member
215 Notch to accommodate ledge 440 of male outer housing 400
215A Notch region of male inner housing at an area extending beyond the suspension
216 Top Surface of Notch
218 Platform at bottom of male inner housing
220 Electrical wire in male inner housing
222 Electrical crimp

225 Male terminal box
226 Locking protrusion on male terminal box
227 Ramp on locking protrusion
228 Blade
230 Fork-receiving aperture on front interior wall (mating aperture)
232 Fork-receiving aperture on left interior wall (mating aperture)
234 Fork-receiving aperture on back interior wall (mating aperture)
236 Fork-receiving aperture on right interior wall (mating aperture)
240 Fork-shaped protrusion (mating protrusion)
242 Fork-shaped protrusion (mating protrusion)
244 Fork-shaped protrusion (mating protrusion)
246 Fork-shaped protrusion (mating protrusion)
250 Aperture
252 Aperture
254 Aperture
256 Aperture
260 Aperture on back of male inner housing to accommodate male TPA member
264 Alignment groove
266 Alignment groove
270 Ramp on first side of platform
272 Ramp on second side of platform
274 Ramp on third side of platform
276 Ramp on fourth side of platform
**270*a*** Apertures
**272*a*** Apertures
**274*a*** Apertures
**276*a*** Apertures
280 Locking protrusion (with ramp) on male inner housing
300 Suspension (first embodiment)
300A Suspension (second embodiment)
301 Upper Portion of suspension
303 Lower Portion of suspension
310 Top of suspension
320 Bottom of suspension
330 Upper edge of ramp
332 Main body of ramp
334 Lower edge of ramp
336 Cushioning resilient features
400 Male outer housing (outer housing)
405 Bottom aperture of male outer housing
410 Top of male outer housing
420 Bottom of male outer housing
440 Ledge
C Separation Line

We claim:

1. A connector system, comprising:
a first connector having a first end; and
a second connector including:
an inner housing forming a first aperture and a notch;
a suspension on the inner housing wherein the suspension engages the notch; and
an outer housing on the suspension, wherein the first end of the first connector is received by the first aperture of the inner housing,
wherein the suspension has an interior forming a ramp, wherein the ramp has an upper edge, a main body, and a lower edge, wherein the lower edge extends inward, wherein the inner housing has a top forming the first aperture, wherein the inner housing has a back as an exterior surface, wherein the back forms a second aperture for receiving a first terminal position assurance member.

2. The connector system according to claim 1, wherein the first connector forms a plurality of mating protrusions and mating apertures.

3. The connector system according to claim 2, wherein the inner housing forms a plurality of mating protrusions and mating apertures.

4. The connector system according to claim 3, wherein each one of the mating protrusions on the first connector is received by a respective one of the mating apertures on the inner housing.

5. The connector system according to claim 3, wherein each one of the mating protrusions on the inner housing is received by a respective one of the mating apertures on the first connector.

6. The connector system according to claim 1, wherein the suspension is flexible.

7. The connector system according to claim 1, wherein the first connector, inner housing, and outer housing are substantially inflexible.

8. The connector system according to claim 1, wherein the upper edge extends inward.

9. The connector system according to claim 8, wherein the first connector has a back as an exterior surface, wherein the back has an aperture for receiving a second terminal position assurance member.

10. A method of assembling a connector system, comprising:
inserting a first terminal position assurance member into a first aperture on a back of a first connector;
inserting a second terminal position assurance member into a first aperture on a back of an inner housing;
inserting the inner housing into an aperture of a suspension, wherein the suspension engages a notch of the inner housing;
inserting a bottom end of the inner housing into a bottom aperture of an outer housing; and
inserting a bottom end of the first connector into a second aperture of the inner housing.

11. The method according to claim 10, wherein the suspension is flexible.

12. The method according to claim 10, wherein the suspension is formed of a synthetic material.

13. The method according to claim 10, wherein a ramp is formed on an interior of the suspension, wherein the ramp has an upper edge, a main body, and a lower edge.

14. The method according to claim 13, wherein the upper edge, main body, and lower edge create a substantially Z-shaped structure.

15. The method according to claim 14, wherein at least a portion of the upper edge of the ramp is received by the notch, wherein the upper edge of the ramp engages a first side of the notch, and wherein the lower edge of the ramp engages a second side of the notch.

16. The method according to claim 10, further comprising:
coupling the outer housing to a first body; and
coupling the first connector to a second body.

17. A connector system, comprising:
a first connector having a bottom end and a back exterior surface, wherein the back exterior surface forms a first aperture for receiving a first terminal position assurance member;
an inner housing having a top and a back exterior surface, wherein the top forms a first aperture and the back exterior surface forms a second aperture for receiving a second terminal position assurance member;

a suspension on the inner housing, wherein the suspension is flexible; and an outer housing on the suspension, wherein the bottom end of the first connector is received by the first aperture of the inner housing.

18. The connector system according to claim 17, wherein the first terminal position assurance member has a beveled edge accommodating a portion of a first terminal.

19. The connector system according to claim 18, wherein the second terminal position assurance member has a beveled edge accommodating a portion of a second terminal.

20. The connector system according to claim 17, wherein the inner housing can move within the outer housing, because of a flexibility of the suspension, when the bottom end of the first connector is received by the first aperture of the inner housing.

* * * * *